US008904951B1

(12) United States Patent
Hronek

(10) Patent No.: US 8,904,951 B1
(45) Date of Patent: Dec. 9, 2014

(54) DEVICE FOR RECORDING BASEBALL GAME DATA, PARTICULARLY ADAPTED TO BE WORN BY A USER

(76) Inventor: Brian R. Hronek, Cincinnati, OH (US)

( * ) Notice: Subject to any disclaimer, the term of this patent is extended or adjusted under 35 U.S.C. 154(b) by 701 days.

(21) Appl. No.: 13/190,438

(22) Filed: Jul. 25, 2011

(51) Int. Cl.
*A63B 71/06* (2006.01)
*G09F 11/00* (2006.01)
*G09F 11/23* (2006.01)

(52) U.S. Cl.
USPC ..... 116/225; 116/223; 116/316; 116/317; 116/322

(58) Field of Classification Search
CPC ..... A63B 71/06; A63B 71/0669; A63B 71/0672; A63B 2071/06; A63B 2071/0602; A63B 2071/0663; A63B 2071/0694; A63F 11/0051; G06F 11/00; G06F 11/23
USPC ..... 116/222, 221, 223, 224, 225, 309, 311, 116/312, 313, 315, 316, 317, 319, 320, 321, 116/322, 323, 324; 40/5, 633, 665; 235/1 B; 273/DIG. 26; D10/46.1
See application file for complete search history.

(56) References Cited

U.S. PATENT DOCUMENTS

| | | | | | |
|---|---|---|---|---|---|
| 153,160 | A | * | 7/1874 | Dunham | 116/323 |
| 818,591 | A | * | 4/1906 | Weston | 116/225 |
| 979,997 | A | * | 12/1910 | Pauly | 235/114 |
| 1,000,026 | A | * | 8/1911 | Lewis | 235/113 |
| 1,755,995 | A | * | 4/1930 | Lamb | 235/122 |
| 1,785,288 | A | * | 12/1930 | Swarthout | 235/114 |
| 1,833,223 | A | * | 11/1931 | Morenus | 235/124 |
| 1,934,538 | A | * | 11/1933 | Hedricks | 235/124 |
| D159,316 | S | * | 7/1950 | Beach | D10/46.1 |
| 2,842,314 | A | * | 7/1958 | McKennett | 235/114 |

(Continued)

FOREIGN PATENT DOCUMENTS

| | | | | | |
|---|---|---|---|---|---|
| EP | 24552 | A1 | * | 3/1981 | A63B 71/06 |
| FR | 2680696 | A1 | * | 3/1993 | A63B 71/06 |
| JP | 2004261541 | A | * | 9/2004 | A63B 71/06 |
| JP | 3162715 | U | * | 9/2010 | A63B 71/06 |

OTHER PUBLICATIONS

Printed page(s) from amazon.com website that depicts a plurality of umpire counters, dated Jul. 22, 2011.

*Primary Examiner* — R. A. Smith
(74) *Attorney, Agent, or Firm* — The Law Office of Patrick F. O'Reilly III, LLC

(57) ABSTRACT

A device for recording baseball or softball game data includes a band adapted to fit around a limb of a user, the band having an inner surface configured to face inwardly towards the circumference of the limb, and an opposed, outer surface configured to face outwardly away from the circumference of the limb; a base plate attached to the outer surface of the band or an end portion of the band; a front cover attached to the base plate, the front cover having at least one aperture disposed therethrough or at least one viewing window disposed therein; at least one plurality of numbers, the plurality of numbers configured to represent differing quantities of balls, strikes, outs, or innings during a baseball or softball game inscribed on the device; at least one number of the at least one plurality of numbers configured to be visible through the aperture or the viewing window of the front cover; and at least one indicium inscribed on the device near the at least one plurality of numbers, the indicium labeling the plurality of numbers as either balls, strikes, outs, or innings.

20 Claims, 11 Drawing Sheets

(56) References Cited

U.S. PATENT DOCUMENTS

| | | | | | |
|---|---|---|---|---|---|
| 3,122,851 | A | * | 3/1964 | Sepe | 116/223 |
| 3,455,273 | A | * | 7/1969 | Willingham, Jr. | 116/223 |
| 3,584,597 | A | * | 6/1971 | Simmons | 116/225 |
| 3,739,740 | A | * | 6/1973 | Fromer | 116/308 |
| 3,837,317 | A | * | 9/1974 | Hanauer | 116/311 |
| 3,847,110 | A | * | 11/1974 | Inoue | 116/223 |
| 3,936,963 | A | * | 2/1976 | Chan | 40/492 |
| 4,072,125 | A | * | 2/1978 | Spalla | 116/223 |
| 4,158,342 | A | * | 6/1979 | Scruggs | 116/225 |
| 4,164,910 | A | * | 8/1979 | Feiler | 116/225 |
| 4,331,098 | A | * | 5/1982 | Rubano | 116/225 |
| 4,557,215 | A | * | 12/1985 | Petersson | 116/222 |
| 4,625,675 | A | * | 12/1986 | Rosenberg | 116/324 |
| 4,738,449 | A | * | 4/1988 | Droz | 473/553 |
| 4,886,010 | A | * | 12/1989 | Stutzman | 116/308 |
| 4,921,251 | A | * | 5/1990 | Kanenwisher | 273/244.1 |
| 4,922,850 | A | * | 5/1990 | Conley | 116/222 |
| 5,181,009 | A | * | 1/1993 | Perona | 340/407.1 |
| 5,386,795 | A | * | 2/1995 | Bartholomew | 116/308 |
| 6,210,296 | B1 | * | 4/2001 | Gabriel | 473/464 |
| 2009/0025625 | A1 | * | 1/2009 | Lee | 116/223 |

* cited by examiner

Section A-A

Section B-B

Section A-A

Section B-B

Section A-A

Section B-B

DEVICE FOR RECORDING BASEBALL GAME DATA, PARTICULARLY ADAPTED TO BE WORN BY A USER

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a device for recording baseball or softball game data, such as balls, strikes, outs, or innings. More particularly, the invention relates to a wearable device for recording baseball or softball game data that is designed to fit around the limb of a user.

2. Background and Related Art

Unquestionably, baseball is one of the most popular sports in the world today. Unlike contact sports, such as football and rugby, baseball does not pose a substantial risk of serious injury to its players. Thus, it can be enjoyed by people of all ages, ranging from very young children to senior citizens. Regardless of the participants in a baseball game, the rules and numerical data used to govern the progression of a baseball game remain unchanged. The progression of a baseball game is governed by the count associated with a particular batter (i.e., the number of balls and strikes for the batter), the number of outs acquired by a team during their half of an inning, and the inning number in the game. Even though it may seem that this numerical data is relatively simple in nature, keeping accurate track of baseball game data is often very challenging for a player, a coach, or a spectator, who is thoroughly immersed in the excitement of a baseball game. This is particularly true for youth baseball games. Consequently, while playing a baseball game, children and their coaches frequently ask the umpire for the count.

The same problems are encountered during the context of a softball game. Rather than being able to fully focus on the game at hand, players and their coaches often lose track of the count, and thus, need to periodically ask the umpire for such information. These constant inquiries interfere with the natural progression of the game.

While others have developed devices that are generally capable of recording baseball or softball game information (e.g., umpire counters), these devices have numerous limitations and drawbacks. First, related art devices are not designed to be worn by a user. Thus, it is very difficult for coaches, and especially players, to use these devices during the context of a baseball or softball game. Secondly, the devices taught by the related art are formed from rigid materials, such as metals and hard plastics, which are not suitable for use by players of a baseball or softball game. Finally, these related art devices typically utilize complex, intricately formed components that are both difficult and expensive to manufacture, which results in a higher cost to the consumer.

Therefore, what is needed is a device for recording baseball or softball game data that is particularly adapted to be worn by a user thereof. Moreover, a device for recording baseball or softball game data is needed that is formed using pliable materials that are readily flexible and capable of absorbing an impact without resulting in player injuries. Furthermore, a need exists for a device for recording baseball or softball game data that has a simple design, which is easy and inexpensive to manufacture.

BRIEF SUMMARY OF THE INVENTION

Accordingly, the present invention is directed to a device for recording baseball or softball game data that substantially obviates one or more problems resulting from the limitations and deficiencies of the related art.

A first object of the present invention is to provide a device for recording baseball or softball game data that is particularly adapted to be worn by a user thereof so as to obviate the need for carrying the device.

A second object of the present invention is to provide a device for recording baseball or softball game data that is formed with pliable materials that are readily flexible and capable of absorbing an impact without causing injuries to players.

A third object of the present invention is to provide a device for recording baseball or softball game data that has a simple design, which is easy and inexpensive to manufacture.

A fourth object of the present invention is to provide a device for recording baseball or softball game data that contains no gears and no electronic components, which add to the overall complexity of a device.

The aforedescribed objects are merely illustrative in nature. Additional objects and advantages of the present invention will be apparent from the following detailed description, the accompanying drawings, and the appended claims.

To achieve one or more of these objects and advantages, in accordance with a first aspect of the present invention, there is provided a device for recording baseball or softball game data that includes: a band adapted to fit around a limb of a user, the band having an inner surface configured to face inwardly towards the circumference of the limb, and an opposed, outer surface configured to face outwardly away from the circumference of the limb; a base plate attached to the outer surface of the band or an end portion of the band; a front cover attached to the base plate, the front cover having at least one aperture disposed therethrough or at least one viewing window disposed therein; at least one plurality of numbers, the plurality of numbers configured to represent differing quantities of balls, strikes, outs, or innings during a baseball or softball game inscribed on the device; at least one number of the at least one plurality of numbers configured to be visible through the aperture or the viewing window of the front cover; and at least one indicium inscribed on the device near the at least one plurality of numbers, the indicium labeling the plurality of numbers as either balls, strikes, outs, or innings.

In a preferred embodiment of this aspect of the present invention, the device further includes a back cover disposed between the front cover and the base plate.

In another preferred embodiment, the at least one plurality of numbers is inscribed on the back cover in a substantially linear arrangement.

In yet another preferred embodiment, the device further includes at least one movable strip slidably disposed between the front cover and the back cover, the at least one strip being configured to cover one or more of the numbers such that a particular quantity, or quantities, of balls, strikes, or outs is made selectively visible; wherein the at least one movable strip is displaceable in a substantially linear manner by the user.

In still another preferred embodiment, the device further includes at least one movable strip slidably disposed between the front cover and the back cover, the at least one movable strip having a viewing aperture disposed therethrough; wherein the at least one movable strip is configured to cover at least two numbers of the at least one plurality of numbers such that a particular quantity of balls, strikes, or outs is made selectively visible through the viewing aperture of the at least one movable strip; and wherein the at least one movable strip is displaceable in a substantially linear manner by the user.

In yet another preferred embodiment, the device further includes at least one movable disk rotatably disposed between the front cover and the back cover, the at least one movable disk having a viewing aperture disposed therethrough; wherein the at least one plurality of numbers is inscribed on the back cover in a semi-circular arrangement; and wherein the at least one movable disk is configured to cover at least two numbers of the plurality of numbers such that either a blank space or a particular quantity of balls, strikes, or outs is made selectively visible through the viewing aperture of the at least one movable disk; the at least one movable disk being displaceable in a substantially circular manner by the user.

In still another preferred embodiment, the at least one plurality of numbers comprises a first plurality of numbers representing differing quantities of balls, a second plurality of numbers representing differing quantities of strikes, and a third plurality of numbers representing differing quantities of outs; wherein the numbers in each of the first, second, and third pluralities of numbers are inscribed in a respective substantially linear arrangement across the back cover; and wherein the first plurality of numbers is located above the second plurality of numbers, and the second plurality of numbers is located above the third plurality of numbers.

In yet another preferred embodiment, the device further includes three independently movable strips disposed between the front cover and the back cover, the first of the three independently movable strips being configured to cover one or more numbers of the first plurality of numbers representing the differing quantities of balls, the second of the three independently movable strips being configured to cover one or more numbers of the second plurality of numbers representing the differing quantities of strikes, and the third of the three independently movable strips being configured to cover one or more numbers of the third plurality of numbers representing the differing quantities of outs.

In still another preferred embodiment, the device further includes three independently movable strips disposed between the front cover and the back cover, each of the three independently movable strips having a viewing aperture disposed therethrough; the first of the three independently movable strips being configured to cover at least two numbers of the first plurality of numbers representing the differing quantities of balls such that a particular quantity of balls is made selectively visible through the viewing aperture of the first independently movable strip, the second of the three independently movable strips being configured to cover at least two numbers of the second plurality of numbers representing the differing quantities of strikes such that a particular quantity of strikes is made selectively visible through the viewing aperture of the second independently movable strip, and the third of the three independently movable strips being configured to cover at least two numbers of the third plurality of numbers representing the differing quantities of outs such that a particular quantity of outs is made selectively visible through the viewing aperture of the third independently movable strip.

In yet another preferred embodiment, the device further includes four independently movable disks rotatably disposed between the front cover and the back cover, each of the four independently movable disks having a viewing aperture disposed therethrough; wherein the at least one plurality of numbers comprises a first plurality of numbers representing differing quantities of balls, a second plurality of numbers representing differing quantities of strikes, a third plurality of numbers representing differing quantities of outs, and a fourth plurality of numbers representing differing quantities of innings, the numbers in each of the first, second, third, and fourth pluralities of numbers being inscribed on the back cover in a respective semi-circular arrangement; and wherein the first of the four independently movable disks is configured to cover at least two numbers of the first plurality of numbers representing the differing quantities of balls such that either a blank space or a particular quantity of balls is made selectively visible through the viewing aperture of the first independently movable disk, the second of the four independently movable disks is configured to cover at least two numbers of the second plurality of numbers representing the differing quantities of strikes such that either a blank space or a particular quantity of strikes is made selectively visible through the viewing aperture of the second independently movable disk, the third of the four independently movable disks is configured to cover at least two numbers of the third plurality of numbers representing the differing quantities of outs such that either a blank space or a particular quantity of outs is made selectively visible through the viewing aperture of the third independently movable disk, and the fourth of the four independently movable disks is configured to cover at least eight numbers of the fourth plurality of numbers representing the differing quantities of innings such that a particular quantity of innings is made selectively visible through the viewing aperture of the fourth independently movable disk.

In still another preferred embodiment, the at least one plurality of numbers is inscribed on a movable strip in a substantially linear arrangement, the movable strip being slidably disposed between the front cover and the base plate; wherein one number of the plurality of numbers is configured to be selectively visible through the aperture or the viewing window of the front cover, and the remainder of the plurality of numbers are configured to be concealed behind the front cover of the device.

In yet another preferred embodiment, the device further includes three independently movable strips slidably disposed between the front cover and the base plate; wherein the at least one plurality of numbers comprises a first plurality of numbers representing differing quantities of balls, a second plurality of numbers representing differing quantities of strikes, and a third plurality of numbers representing differing quantities of outs, the numbers in the first plurality of numbers being inscribed on the first of the three independently movable strips in a substantially linear manner, the numbers in the second plurality of numbers being inscribed on the second of the three independently movable strips in a substantially linear manner, and the numbers in the third plurality of numbers being inscribed on the third of the three independently movable strips in a substantially linear manner; wherein the at least one aperture or the at least one viewing window of the front cover comprises three apertures disposed through the front cover or three viewing windows disposed in the front cover; wherein one number of the first plurality of numbers is configured to be selectively visible through a first of the three apertures or a first of the three viewing windows in the front cover and the remainder of the first plurality of numbers are configured to be concealed behind the front cover; one number of the second plurality of numbers is configured to be selectively visible through a second of the three apertures or a second of the three viewing windows in the front cover and the remainder of the second plurality of numbers are configured to be concealed behind the front cover; and one number of the third plurality of numbers is configured to be selectively visible through a third of the three apertures or a third of the three viewing windows in the front cover and the remainder of the third plurality of numbers are configured to be concealed behind the front cover.

In still another preferred embodiment, the band is in the form of a wrist band or an arm band.

In yet another preferred embodiment, the wrist band or arm band is formed from a continuous loop of terrycloth that is both stretchable and capable of absorbing moisture.

In still another preferred embodiment, at least one of the base plate and the front cover is formed from rubber or another pliable polymeric material.

In yet another preferred embodiment, the at least one indicium comprises one of the following: (1) a first letter abbreviation for the word "balls", "strikes", or "outs" inscribed on the device near the at least one plurality of numbers; or (2) the complete word "balls", "strikes", or "outs" inscribed on the device near the at least one plurality of numbers.

In accordance with a second aspect of the present invention, there is provided a device for recording baseball or softball game data that includes: a band adapted to fit around a limb of a user, the band having an inner surface configured to face inwardly towards the circumference of the limb, and an opposed, outer surface configured to face outwardly away from the circumference of the limb; a base plate attached to the outer surface of the band; a front cover attached to the base plate, the front cover having at least one aperture disposed therethrough or at least one viewing window disposed therein; at least one displaceable member movably disposed between the front cover and the base plate; at least one plurality of numbers, the plurality of numbers configured to represent differing quantities of balls, strikes, or outs during a baseball or softball game inscribed on the base plate; at least one number of the at least one plurality of numbers being visible through the aperture or the viewing window of the front cover; and at least one indicium inscribed on the device near the at least one plurality of numbers, the indicium labeling the plurality of numbers as either balls, strikes, or outs; wherein the at least one displaceable member is configured to cover one or more numbers of the plurality of numbers such that a particular quantity, or quantities, of the balls, strikes, or outs is made selectively visible.

In a preferred embodiment of this aspect of the present invention, the at least one plurality of numbers comprises a first plurality of numbers representing differing quantities of balls, a second plurality of numbers representing differing quantities of strikes, and a third plurality of numbers representing differing quantities of outs; wherein the numbers in each of the first, second, and third pluralities of numbers are inscribed in a respective substantially linear arrangement across the base plate, the first plurality of numbers being located above the second plurality of numbers, and the second plurality of numbers being located above the third plurality of numbers; and wherein at least one displaceable member comprises three independently movable strips disposed between the front cover and the base plate, the first of the three independently movable strips being configured to cover one or more numbers of the first plurality of numbers representing the differing quantities of balls, the second of the three independently movable strips being configured to cover one or more numbers of the second plurality of numbers representing the differing quantities of strikes, and the third of the three independently movable strips being configured to cover one or more numbers of the third plurality of numbers representing the differing quantities of outs.

In accordance with a third aspect of the present invention, there is provided a device for recording baseball or softball game data that includes: a base plate; a front cover attached to the base plate, the front cover having a plurality of apertures disposed therethrough or a plurality of viewing windows disposed therein; a plurality of displaceable members movably disposed between the front cover and the base plate; a first plurality of numbers configured to represent differing quantities of balls during a baseball or softball game inscribed on the base plate, at least one number of the first plurality of numbers being visible through a first of the plurality of apertures or a first of the plurality of viewing windows in the front cover; a second plurality of numbers configured to represent differing quantities of strikes during a baseball or softball game inscribed on the base plate, at least one number of the second plurality of numbers being visible through a second of the plurality of apertures or a second of the plurality of viewing windows in the front cover; a third plurality of numbers configured to represent differing quantities of outs during a baseball or softball game inscribed on the base plate, at least one number of the third plurality of numbers being visible through a third of the plurality of apertures or a third of the plurality of viewing windows in the front cover; a first indicium inscribed on the device near the first plurality of numbers, the first indicium labeling the first plurality of numbers as balls; a second indicium inscribed on the device near the second plurality of numbers, the second indicium labeling the second plurality of numbers as strikes; and a third indicium inscribed on the device near the third plurality of numbers, the third indicium labeling the third plurality of numbers as outs; wherein a first of the plurality of displaceable members is configured to cover one or more numbers of the first plurality of numbers such that a particular quantity, or quantities, of balls is made selectively visible; wherein a second of the plurality of displaceable members is configured to cover one or more numbers of the second plurality of numbers such that a particular quantity, or quantities, of strikes is made selectively visible; and wherein a third of the plurality of displaceable members is configured to cover one or more numbers of the third plurality of numbers such that a particular quantity, or quantities, of outs is made selectively visible.

In a preferred embodiment of this aspect of the present invention, the device further includes three independently movable strips disposed between the front cover and the base plate, each of the three independently movable strips having a viewing aperture disposed therethrough; the first of the three independently movable strips being configured to cover at least two numbers of the first plurality of numbers representing the differing quantities of balls such that a particular quantity of the balls is made selectively visible through the viewing aperture of the first independently movable strip, the second of the three independently movable strips being configured to cover at least two numbers of the second plurality of numbers representing the differing quantities of strikes such that a particular quantity of the strikes is made selectively visible through the viewing aperture of the second independently movable strip, and the third of the three independently movable strips being configured to cover at least two numbers of the third plurality of numbers representing the differing quantities of outs such that a particular quantity of the outs is made selectively visible through the viewing aperture of the third independently movable strip.

It is to be understood that the foregoing objects and summary, and the following detailed description of the present invention, are merely exemplary and explanatory in nature. As such, the foregoing objects and summary, and the following detailed description of the invention, should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts of a particular embodiment are always denoted using the same reference characters so that, as a general rule, they will only be described once with regard to any single embodiment of the invention.

DETAILED DESCRIPTION OF THE INVENTION

1. First Embodiment

Figure 1:
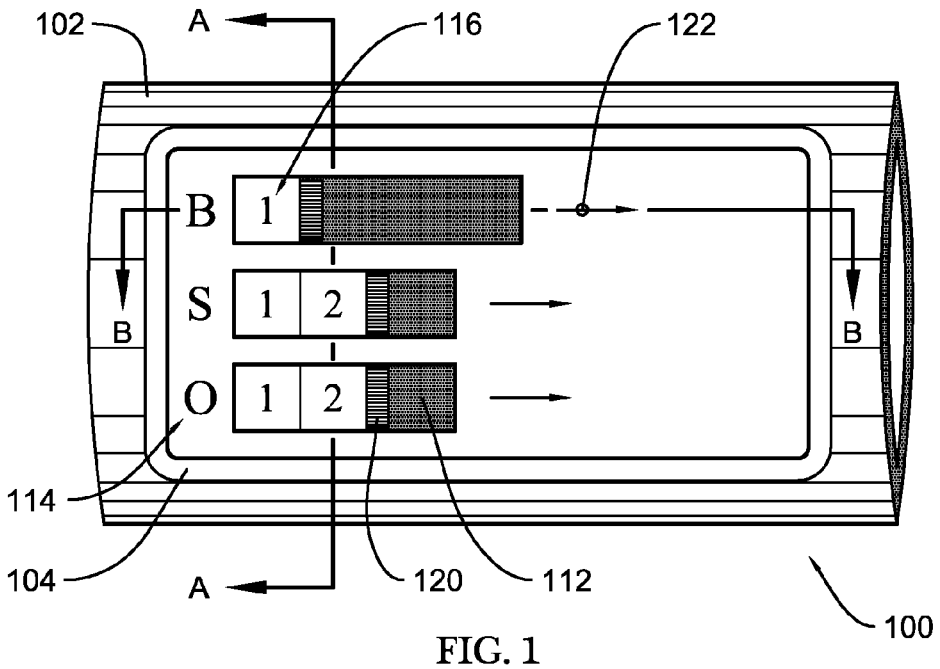
FIG. 1 is a front view of a device for recording baseball or softball game data according to a first embodiment of the invention.

A first embodiment of a device for recording baseball or softball game data is seen generally at 100 in FIG. 1. The device 100 of FIG. 1 is a wearable type device, which is adapted to be worn by a user thereof. Now, referring to FIGS. 1-7, which illustrate various features of the first embodiment of the invention, it can be seen that the device 100 preferably includes a band 102, a base plate 104 attached to the band 102, a front cover 108 disposed on the base plate 104, a back cover 106 sandwiched between the front cover 108 and the base plate 104, and a plurality of movable strips 112 slidably disposed between the front cover 108 and the back cover 106. In the first embodiment of the invention, the movable strips 112 can be selectively displaced by a user so as to cover and uncover differing quantities of balls, strikes, or outs.

Figure 2:
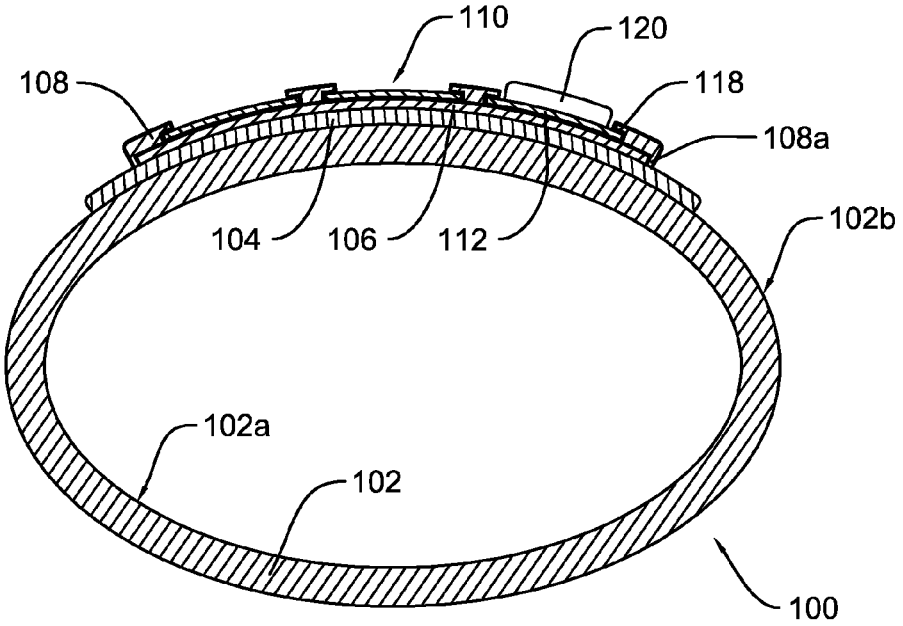
FIG. 2 is a transverse sectional view of the device for recording baseball or softball game data according to the first embodiment of the invention, which is cut along the cutting-plane line A-A in FIG. 1.
Figure 3:
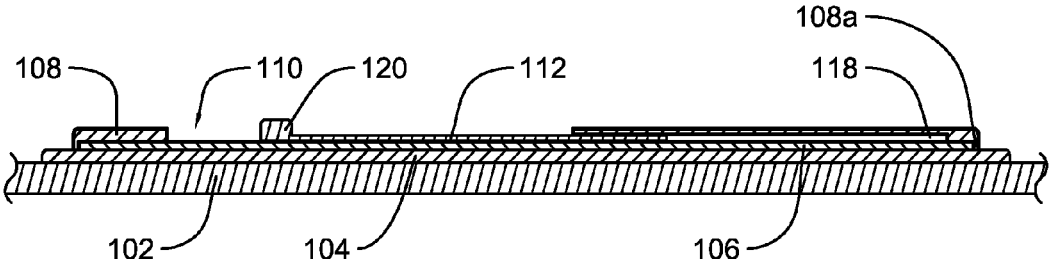
FIG. 3 is a partial longitudinal sectional view of the device for recording baseball or softball game data according to the first embodiment of the invention, which is cut along the cutting-plane line B-B in FIG. 1.

As best shown in FIGS. 1-3, the base plate 104 of the device 100 is fixedly attached to the outer surface **102*b* of the band 102. The base plate 104 has a smaller footprint than the band 102, and is positioned on the band 102 such that its peripheral edge is spaced apart from the edge of the band 102 by a substantially equal distance on all sides thereof (see FIG. 1). The affixation of the base plate 104 to the outer surface 102*b*** of the band 102 can be achieved by various means that include, but are not limited to, stitching (e.g., by sewing), by using an adhesive (e.g., a glue), by utilizing fasteners, or by heat fusing the two materials together. In the first embodiment of the invention, the band 102 has an elongated, tubular geometry and is designed to fit around the limb of a user (i.e., the arm or the leg of a user). When the device 100 is worn by a user, the inner surface 102*a* of the band 102 faces inwardly towards the circumference of the user's limb, while the outer surface 102*b* of the band 102, on which the base plate 104 is mounted, faces outwardly away from the circumference of the user's limb. In a preferred embodiment of the invention, the band 102 depicted in FIGS. 1-3 is in the form of a wrist or arm band, which is formed from a continuous loop of terry-cloth that is both stretchable and capable of absorbing moisture. However, one of ordinary skill in the art will appreciate that the band 102 can be formed using other materials, such as a flexible polymer, without departing from the scope and spirit of the invention. In the sectional view of FIG. 2, the band 102 is depicted as having an elliptical cross-section. It is to be understood that FIG. 2 is intended to be an exemplary illustration of a stretchable wrist or arm band 102 in its unstretched or "relaxed" state prior to being placed on the limb of a user. Once the wrist or arm band 102 is placed around a limb of a user, it will become stretched and its cross-section will more closely resemble a circular ring, rather than the elliptical ring of FIG. 2.

Figure 5:
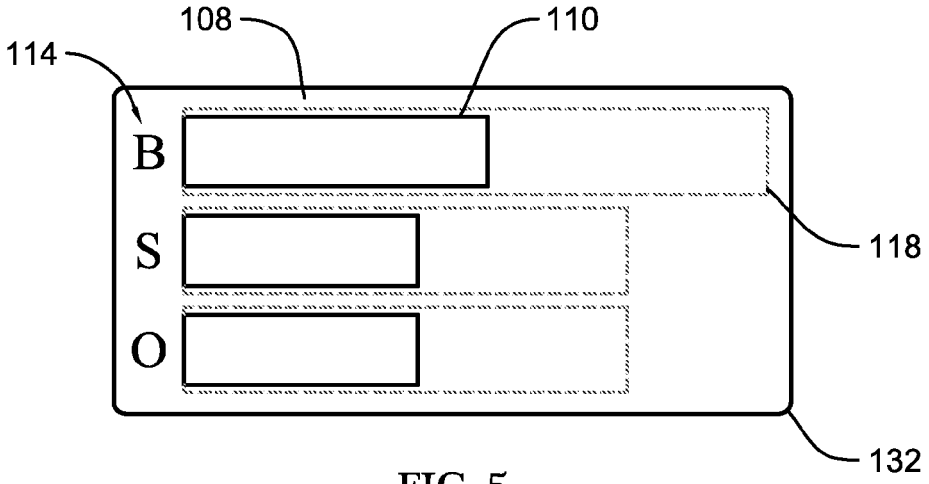
FIG. 5 is a front view of the front cover of the device for recording baseball or softball game data according to the first embodiment of the invention.
Figure 6:
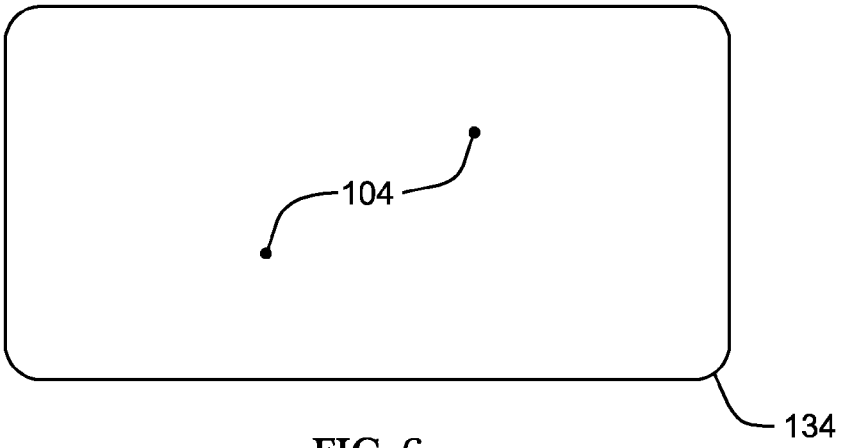
FIG. 6 is a front view of the base plate of the device for recording baseball or softball game data according to the first embodiment of the invention.

Referring to the sectional views in FIGS. 2 and 3, it can be seen that a rear peripheral lip 108*a* of front cover 108 is affixed to the front surface of the base plate 104. A variety of attachment means may be used to affix the front cover 108 to the base plate 104 including, but not limited to, the use of an adhesive (e.g., a glue), fasteners, or by heat fusing the two materials together. Additional features of the front cover 108 are more readily visible in FIG. 5. As shown in this figure, the front cover 108 is provided with a plurality of viewing apertures 110 disposed therethrough, with labeling indicium 114 inscribed on the front cover 108 next to each one of the plurality of viewing apertures 110. In the embodiment of FIG. 5, the indicium 114 are in the form of a capitalized first letter abbreviation for the words "balls", "strikes", and "outs" (i.e., "B" for "balls", "S" for "strikes", and "O" for "outs"). However, it is to be understood that the invention is not limited to this particular type of indicia. Rather, in other embodiments of the invention, the indicium 114 could be in the form of complete words (i.e., "Balls", "Strikes", and "Outs"), symbols (e.g., the use of a ball symbol for "balls"), or a combination of various forms of indicium 114. Also, rather than being disposed next to the side of each viewing aperture 110, the associated indicium 114 could be positioned above or below the viewing aperture 110.

As represented by hidden lines in FIG. 5, the front cover 108 of the device 100 is provided with a plurality of grooves 118, each one accommodating a respective movable strip 112. The grooves 118 are substantially centered on each of the viewing apertures 110 in a lateral direction of the front cover 108, and have a width that is slightly larger than that of the movable strips 112 so that a small amount of clearance is provided between the lateral sides of the movable strips 112 and the lateral sides of each groove 118. Referring to the sectional views in FIGS. 2 and 3, it can be seen that the depth of each groove is substantially equal to the thickness of each movable strip 112. Each movable strip 112 is disposed between the front surface of the back cover 106 and the surfaces of a respective groove 118. In a preferred embodiment of the invention, the inadvertent movement of each movable strip 112 is prevented by the frictional engagement between the front and rear surfaces of each movable strip 112 and the adjacent front and rear surfaces of the back cover 106 and front cover 108, respectively. Although, in the preferred embodiment, the frictional force between each movable strip 112 and the bounding surfaces of the front and back covers 108, 106 is easily overcome by the force applied to the movable strip 112 by a user such that the movable strips 112 are readily displaceable thereby.

Still referring to FIG. 5, it can be seen that the top viewing aperture 110 and the top groove 118 have a greater length than the two viewing apertures 110 and grooves 118 disposed therebelow. The top viewing aperture 110 and the top groove 118 is required to accommodate the four possible quantities of balls (i.e., 1, 2, 3, and 4), whereas the other two viewing apertures 110 and grooves 118 in the front cover 108 are only required to accommodate three possible quantities for strikes and outs (i.e., 1, 2, and 3). Also, as shown in FIG. 5, the front cover 108 is preferably provided with radiused corners 132 at each of its four corners so as to minimize the presence of sharp edges on the device 100, thereby minimizing the risk of injury to baseball or softball players who are wearing the device 100 during baseball or softball games. Similarly, referring now to the FIGS. 2 and 3, the top edges of the front cover 108 are preferably filleted to reduce sharp edges and prevent player injuries. Like the front cover 108, the base plate 104 is also provided with radiused corners 134 (see FIG. 6) and filleted top edges (refer to FIGS. 2 and 3).

While front cover 108 of FIG. 5 is depicted as having a plurality of viewing apertures 110 for viewing the quantities of balls, strikes, and outs, one of ordinary skill in the art will appreciate that the viewing apertures 110 can be provided with a transparent piece of material disposed therein (e.g., a clear acrylic material) so to create a plurality of viewing windows in the front cover 108. Alternatively, the clear viewing windows could be integrally formed with the remainder of the opaque front cover 108 by utilizing a multi-process molding technique.

Figure 7:
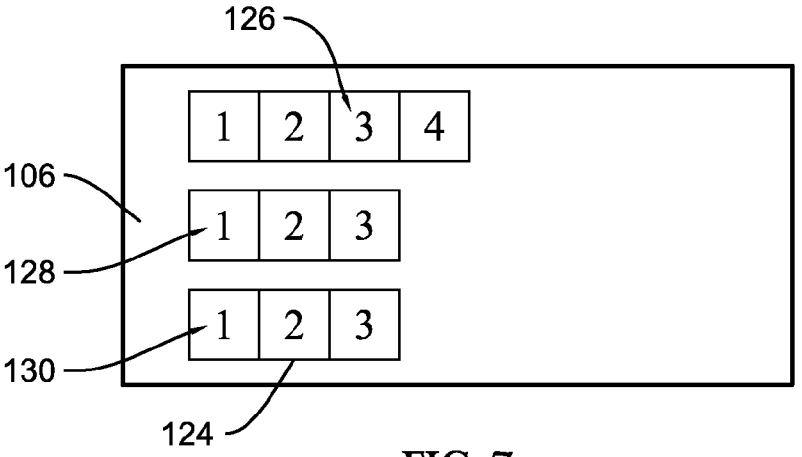
FIG. 7 is a front view of the back cover of the device for recording baseball or softball game data according to the first embodiment of the invention.

Next, the back cover 106 will be described in detail. As shown in FIG. 7, the back cover 106 includes a first, second, and third plurality of numbers 126, 128, and 130 inscribed on the front surface thereof, the numbers of each plurality of numbers 126, 128, 130 being arranged in a respective substantially linear arrangement on the back cover 106, and each plurality of numbers 126, 128, 130 being vertically spaced apart from one another. The first plurality of numbers 126 represents differing quantities of balls (i.e., 1, 2, 3, and 4). The second plurality of numbers 128 represents differing quantities of strikes (i.e., 1, 2, and 3). And, the third plurality of numbers 130 represents differing quantities of outs (i.e., 1, 2, and 3). In FIG. 7, it can be seen that each number of the first, second, and third plurality of numbers 126, 128, and 130 is bounded by a border 124. The purpose of the border 124 around each number is to provide a positional guide so that the user of the device 100 displaces the movable strip 112 to the correct position for a particular number of balls, strikes, or outs. When selecting a particular number on the device 100, the user preferably displaces the left edge of the movable strip 112 until it is substantially aligned with the border line on the right side of the desired number. For example, in FIG. 1, the left edge of the movable strip 112 for selecting the quantity of balls is substantially aligned with the line of the border 124 that is disposed to the right of the number "1", the left edge of the movable strip 112 for selecting the quantity of strikes is substantially aligned with the line of the border 124 that is disposed to the right of the number "2", and the left edge of the movable strip 112 for selecting the quantity of outs is substantially aligned with the line of the border 124 that is disposed to the right of the number "2".

The first, second, and third pluralities of numbers 126, 128, 130 and their associated borders 124 are inscribed on the back cover 106 using various known techniques. For example, in one embodiment of the invention, the first, second, and third pluralities of numbers 126, 128, 130 and borders 124 are printed on the back cover 106 using permanent ink or paint. In another embodiment, the first, second, and third pluralities of numbers 126, 128, 130 and their borders 124 are imprinted into the material of back cover 106 by an engraving method. In yet another embodiment, the first, second, and third pluralities of numbers 126, 128, 130 and their borders 124 are formed by heat fusing a material having a different coloration into the material of the back cover 106.

In a preferred embodiment of the invention, the base plate 104, the back cover 106, and the front cover 108 are preferably formed from a flexible polymeric material or rubber that is readily bendable. As best shown in FIG. 2, forming the base plate 104, the back cover 106, and the front cover 108 from a flexible polymeric material enables these components to generally conform to the curvature of the band 102. It also improves the overall safety of the device 100 because a flexible polymeric material can readily absorb an impact without causing harm to the user who is wearing the device 100. This is particularly important for small children who are wearing the device 100 during a baseball or softball game. The alleviation of hard, rigid materials greatly enhances the suitably of using this device 100 while actively playing a baseball or softball game.

Figure 4:
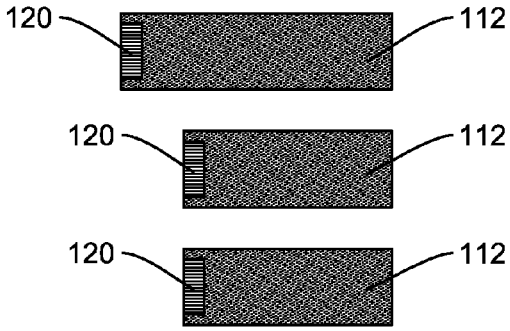
FIG. 4 is a front view of the movable strips of the device for recording baseball or softball game data according to the first embodiment of the invention.

Turning now to FIG. 4, the geometry of the movable strips 112 will be described. As shown in this figure, each of the three movable strips 112 is generally rectangular in shape, and includes a finger engagement protrusion 120 for facilitating the movement of the strip 112 by a user. Similar to the edges of the front cover 108, the front edges of each finger engagement protrusion 120 is filleted (see FIGS. 2 and 3) so as to minimize the presence of sharp edges on the device 100, and the potential for player injuries resulting therefrom. As described above, each movable strip 112 is received within a corresponding groove 118 in the front cover 108. Referring to FIGS. 2 and 3, it can be seen that the finger engagement protrusion 120 extends beyond the front surface of the front cover 108 so that the user is able to more easily engage the movable strip 112 and effectuate the movement thereof.

The length of each movable strip 112 is determined by the total length that is necessary to cover all of the numbers in the first, second, and third pluralities of numbers 126, 128, 130 (i.e., the distance between the leftmost line of the border 124 in FIG. 7 and the rightmost line of that border 124) plus the width of the finger engagement protrusion 120 in the longitudinal direction of the movable strip 112. Thus, because upper movable strip 112 is required to accommodate the four possible quantities of balls (i.e., 1, 2, 3, and 4), whereas the other two movable strips 112 are only required to accommodate three possible quantities for strikes and outs (i.e., 1, 2, and 3), the upper movable strip 112 is approximately 1.3 times the length of the other two movable strips 112. The length of each viewing aperture 110 in the front cover 108 is substantially equal to the length of its associated movable strip 112 such that all numbers are concealed in the fully closed position of each movable strip 112, and further, is approximately equal to the distance between the leftmost line of the border 124 and the rightmost line of the border 124 (see FIG. 7) of its associated plurality of numbers 126, 128, 130 plus the width of the finger engagement protrusion 120 in the longitudinal direction of the movable strip 112. These relative dimensions prevent the finger engagement protrusion 120 of each movable strip 112 from partially covering the rightmost number of its associated plurality of numbers 126, 128, 130 when it is in a fully open position.

While the abovedescribed embodiment of the invention includes a back cover 106 on which the first, second, and third pluralities of numbers 126, 128, 130 are inscribed, it is to be understood that, in other embodiments of the invention, the back cover 106 is omitted and the first, second, and third pluralities of numbers 126, 128, 130, together with their associated borders 124, are inscribed directly on the base plate 104. In embodiments without the back cover 106, the lip 108*a* could be omitted from the front cover 108 because the purpose of the lip 108*a* is to accommodate the material thickness of the back cover 106. In still other embodiments of the invention, the base plate 104 is omitted in lieu of the back cover 106, and the back cover 106 is directly attached to the band 102 via stitching (e.g., by sewing), an adhesive (e.g., a glue), fasteners, or by heat fusing the two materials together.

Now, the operation of the device 100 for recording baseball or softball game data according to the first embodiment of the invention will be explained. First, in a preferred embodiment, a user places the device 100 around one of his or her limbs (e.g., an arm) by stretching the band 102 such that it can be slid over the end of the limb (e.g., over the hand). Then, it is moved to the appropriate place on the limb and is held in place by the frictional engagement between the stretched material (e.g., terrycloth) and the outer circumference of the limb. In the initial state of the device 100 (e.g., before the baseball or softball game has commenced) all three movable strips 112 are in their leftmost positions (see FIG. 1) such that all of the numbers in first, second, and third pluralities of numbers 126, 128, 130 are covered. Then, after a batter obtains his or her first strike or ball, either the movable strip 112 covering the first plurality of numbers 126 or the movable strip 112 covering the second plurality of numbers 128 is moved to the right (in the direction 122) until the left edge of the movable strip 112 is substantially aligned with the line of the border 124 on the right side of the number "1" (see e.g., FIG. 1). As a result of displacing the movable strip 112 in such a manner, the number "1" is visible to the user through the viewing aperture 110 in the front cover 108 (see e.g., number 116 in FIG. 1), while the other numbers of the first, second, and third pluralities of numbers 126, 128, 130 remain covered. As the batter for which the count is being recorded acquires more balls or strikes, the appropriate movable strip 112 is moved to the right side of the appropriate number in the manner described above for the initial ball or strike. Once a batter acquires three strikes, the movable strip 112 associated with the third plurality of numbers 130 is moved to the right (in the direction 122) until the left edge of the movable strip 112 is substantially aligned with the line of the border 124 on the right side of the number "1". Subsequent outs for a particular team are recorded by moving the movable strip 112 to the right until its left edge is substantially aligned with the line of the border 124 on the right side of the numbers "2" and "3".

2. Second Embodiment

Figure 8:
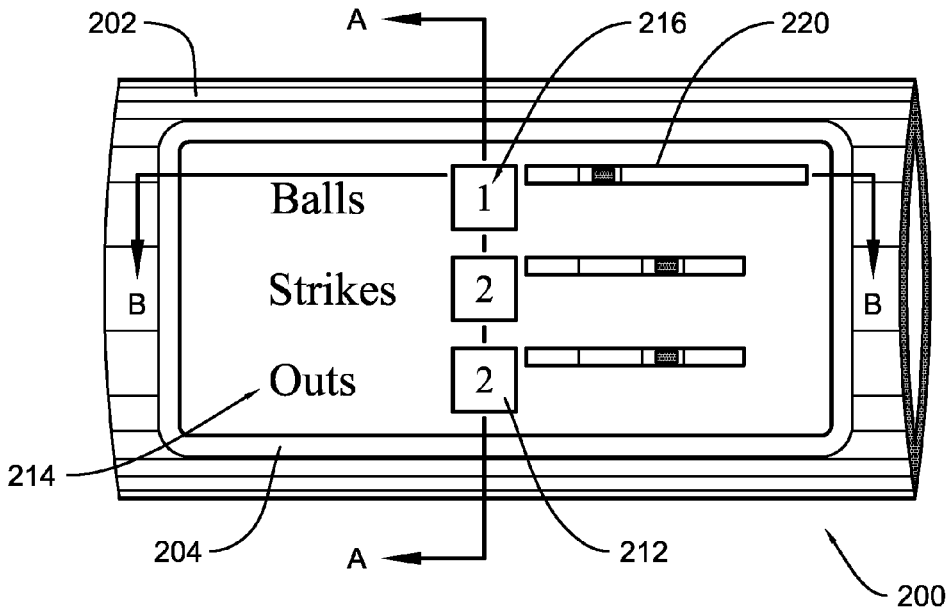
FIG. 8 is a front view of a device for recording baseball or softball game data according to a second embodiment of the invention.

A second embodiment of a device for recording baseball or softball game data is seen generally at 200 in FIG. 8. Like the device 100 described above, the device 200 is a wearable type device, which is adapted to be worn by a user thereof. In some respects, the second embodiment is similar to that of the first embodiment. Moreover, some parts are common to both such embodiments. For the sake of brevity, the parts that the second embodiment of the device for recording baseball or softball game data has in common with the first embodiment will only be mentioned briefly because these components have already been explained in detail above.

However, it is evident from FIGS. 8-14 that the second embodiment of the device for recording baseball or softball game data also differs in several important respects from that of the first embodiment of FIGS. 1-7. The unique features of the second embodiment will be explained in detail below. One of ordinary skill in the art will appreciate that the constituent parts of the first and second embodiments may be readily combined with one another without departing from the spirit and scope of the invention.

Now, referring to FIGS. 8-13, which illustrate various features of the second embodiment of the invention, it can be seen that the device 200 preferably includes a band 202, a base plate 204 attached to the band 202, a front cover 208 disposed on the base plate 204, and a plurality of movable strips 212 slidably disposed between the front cover 208 and the base plate 204. In the second embodiment of the invention, the movable strips 212 can be selectively displaced by a user so as to reveal differing quantities of balls, strikes, or outs.

The physical construction of the band 202 and the base plate 204 in the second embodiment of the invention is the same as that described for the band 102 and the base plate 104 of the first embodiment, as is the manner in which the two components can be attached to one another. Thus, no further discussion of these components is necessary with regard to the second embodiment.

Figure 9:
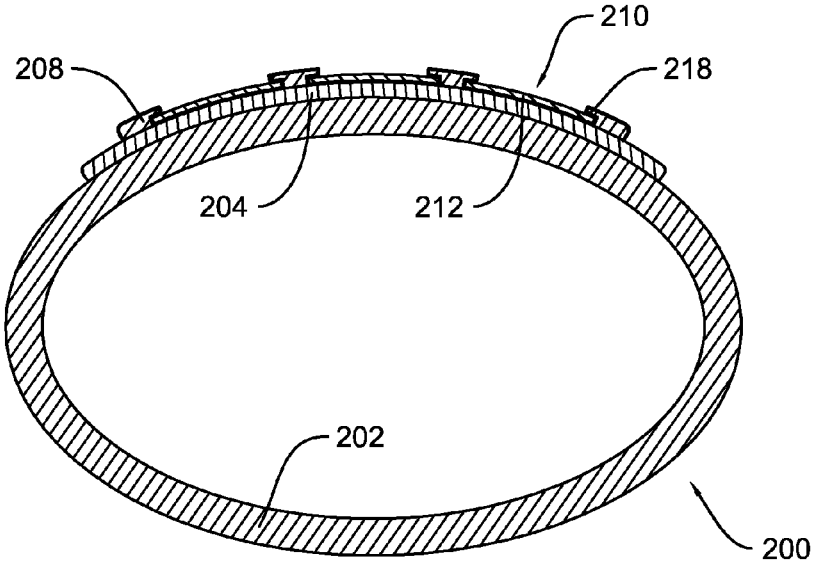
FIG. 9 is a transverse sectional view of the device for recording baseball or softball game data according to the second embodiment of the invention, which is cut along the cutting-plane line A-A in FIG. 8.
Figure 10:
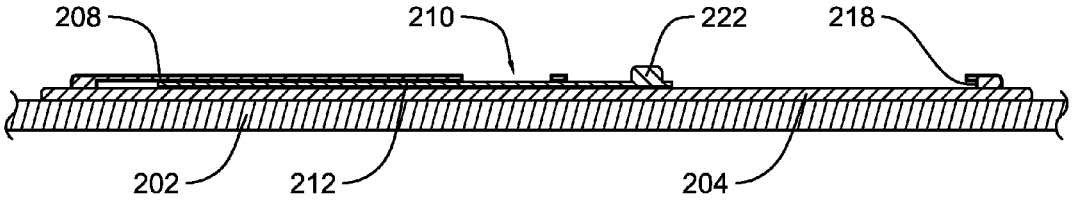
FIG. 10 is a partial longitudinal sectional view of the device for recording baseball or softball game data according to the second embodiment of the invention, which is cut along the cutting-plane line B-B in FIG. 8.
Figure 12:
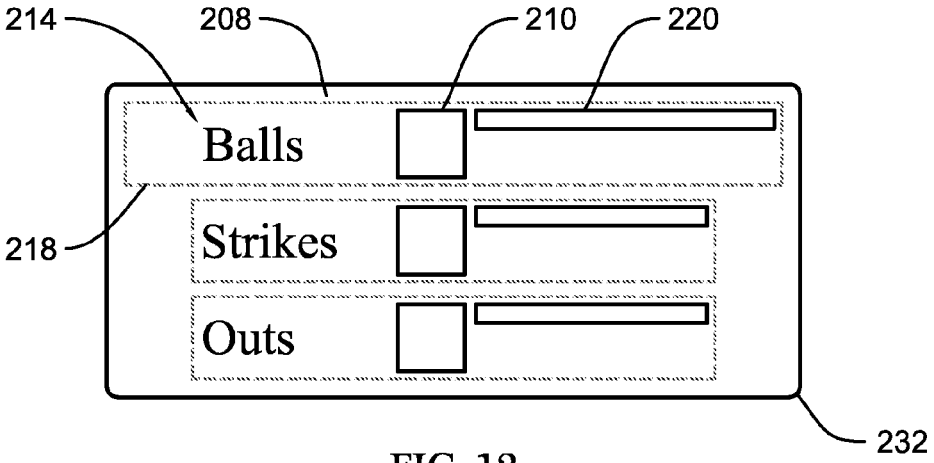
FIG. 12 is a front view of the front cover of the device for recording baseball or softball game data according to the second embodiment of the invention.
Figure 13:
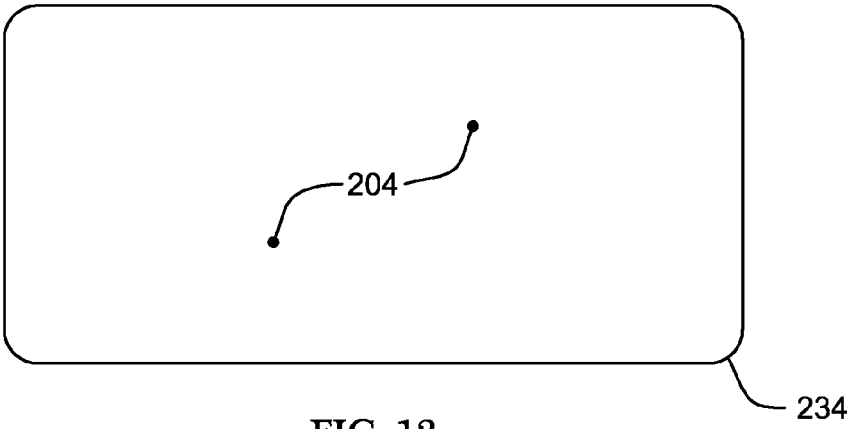
FIG. 13 is a front view of the base plate of the device for recording baseball or softball game data according to the second embodiment of the invention.
Figure 14:
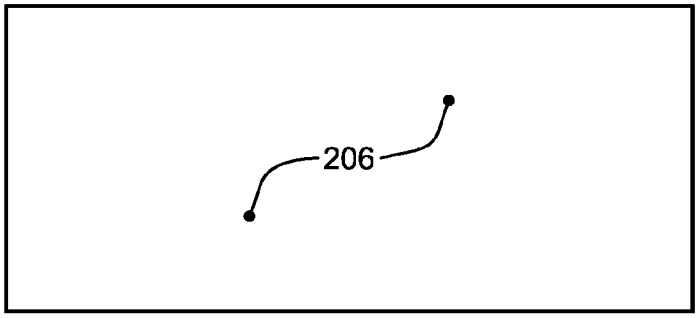
FIG. 14 is a front view of the back cover of the device for recording baseball or softball game data according to the second embodiment of the invention.

Referring to the sectional views in FIGS. 9 and 10, the front cover 208 is affixed to the front surface of the base plate 204 using the attachment means described in the discussion of the first embodiment. Additional features of the front cover 208 are more readily visible in FIG. 12. As shown in this figure, the front cover 208 is provided with a plurality of viewing apertures 210 disposed therethrough, with labeling indicium 214 inscribed on the front cover 208 next to each one of the plurality of viewing apertures 210. In the embodiment of FIG. 12, the indicia 214 are in the form of the words "Balls", "Strikes", and "Outs". However, it is to be understood that the invention is not limited to this particular type of indicia. Rather, in other embodiments of the invention, the indicium 214 could be in the form of a capitalized first letter abbreviation for the words "balls", "strikes", and "outs" (see first embodiment) or symbols (e.g., the use of a ball symbol for "balls"), or a combination of various forms of indicium 214. Also, rather than being disposed next to the side of each viewing aperture 210, the associated indicium 214 could be positioned above or below the viewing aperture 210.

As represented by hidden lines in FIG. 12, the front cover 208 of the device 200 is provided with a plurality of grooves 218, each one accommodating a respective movable strip 212. The construction of the grooves 218 is very similar to that described above for the grooves 118 of the first embodiment, and thus, further elaboration on such construction is not required here. In the second embodiment of the invention, each movable strip 212 is disposed between the front surface of the base plate 204 and the surfaces of a respective groove 218 and, similar to the first embodiment, the inadvertent movement of each movable strip 212 is preferably prevented by the frictional engagement between the front and rear surfaces of each movable strip and the adjacent front and rear surfaces of the base plate 204 and front cover 208, respectively.

Still referring to FIG. 12, it can be seen that all three of the viewing apertures 210 are substantially equal in size. More specifically, each viewing aperture 210 is generally in the shape of square and is sized so as to accommodate the viewing of a single number therethrough (see FIG. 8, one number 216 is visible through each of the three viewing apertures 210). A finger engagement protrusion slot 220 is disposed to the right of each viewing aperture 210 on the front cover 208. Each finger engagement protrusion slot 220 receives a displaceable finger engagement protrusion 222 of a respective movable strip 212 therein. Also, as shown in FIG. 12, the front cover 208 of the second embodiment of the invention is preferably provided with radiused corners 232 for the same reasons explained above with respect to the first embodiment. Moreover, referring now to FIGS. 9 and 10, the top edges of the front cover 208 are preferably filleted to reduce sharp edges and prevent player injuries. Like the front cover 208, the base plate 204 is also provided with radiused corners 234 (see FIG. 13) and filleted top edges (refer to FIGS. 9 and 10).

Figure 11:
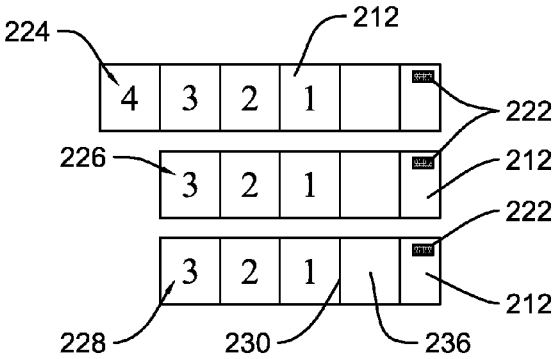
FIG. 11 is a front view of the movable strips of the device for recording baseball or softball game data according to the second embodiment of the invention.

Next, the movable strips 212 will be described in detail. As shown in FIG. 11, the upper movable strip 212 includes a first plurality of numbers 224 inscribed on the front surface thereof and linearly arranged in descending order from left to right (i.e., 4, 3, 2, and 1). The middle and lower movable strips 212 include a respective second and third plurality of numbers 226, 228 inscribed on the front surface thereof and linearly arranged in descending order from left to right (i.e., 3, 2, and 1). Each movable strip 212 also includes a blank space 236 disposed next to the rightmost number of each plurality of numbers 224, 226, 228. The first plurality of numbers 224 represents differing quantities of balls (i.e., 4, 3, 2, and 1). The second plurality of numbers 226 represents differing quantities of strikes (i.e., 3, 2, and 1). And, the third plurality of numbers 228 represents differing quantities of outs (i.e., 3, 2, and 1). In FIG. 11, it can be seen that the sides of each inwardly disposed number of the first, second, and third plurality of numbers 224, 226, and 228 is bounded by a vertical line 230. The purpose of the vertical line 230 next to each number is to provide a positional guide so that the user of the device 200 displaces the movable strip 212 to the correct position for a particular number of balls, strikes, or outs. When selecting a particular number on the device 200, the user preferably displaces the movable strip 212 until the vertical lines 230 (or in the case of the leftmost number, the edge of the movable strip 212 and the vertical line 230) are substantially aligned with the lateral edges of the viewing aperture 210. For example, in FIG. 8, the strip edge and the vertical line 230 disposed on the right side of the number "1" on the movable strip 212 for specifying the quantity of balls are aligned with the lateral edges of the upper viewing aperture 210, the vertical lines 230 disposed on opposite sides of the number "2" on the movable strip 212 for specifying the quantity of strikes are aligned with the lateral edges of the middle viewing aperture 210, and the vertical lines 230 disposed on opposite sides of the number "2" on the movable strip 212 for specifying the quantity of outs are aligned with the lateral edges of the lower viewing aperture 210. The techniques used to inscribe the first, second and third plurality of numbers 224, 226, 228 on their respective movable strips 212 are the same as those described for inscribing the first, second and third plurality of numbers 126, 128, 130 on the back cover 106 in the first embodiment, and thus, the aforedescribed discussion will not be repeated here.

Referring again to FIG. 11, it can be seen that each of the three movable strips 212 is includes a finger engagement protrusion 222 in the upper right hand corner thereof for facilitating the movement of the strip 212 by a user. As was described for the finger engagement protrusions 120 of the first embodiment, the front edges of each finger engagement protrusion 222 is filleted (see e.g., FIG. 10) so as to minimize the presence of sharp edges on the device 200, and the potential for player injuries resulting therefrom. As described above, each movable strip 212 is received within a corresponding groove 218 in the front cover 208. Referring to FIG. 10, it can be seen that the finger engagement protrusion 222 extends beyond the front surface of the front cover 208 so that the user is able to more easily engage the movable strip 212 and effectuate the movement thereof.

The overall length of the groove 218 in the front cover 208 is determined by that which is necessary to accommodate the range of movement of the movable strips 212. Because upper movable strip 212 is required to accommodate the four possible quantities of balls (i.e., 4, 3, 2, and 1) and a blank space 236, whereas the other two movable strips 212 are only required to accommodate three possible quantities for strikes and outs (i.e., 3, 2, and 1), the upper movable strip 212 is approximately 1.2 times the length of the other two movable strips 212. Thus, it follows that the groove 218 required to accommodate the upper movable strip 212 will be the longest of the three grooves 218. To the left of each viewing aperture 210, the corresponding groove 218 must extend a distance that is sufficient to allow all of the numbers on the associated movable strip 212 to be covered by the front cover 208 (i.e., the minimum distance from the left edge of the viewing aperture 210 to the left end of the groove 218 is equal to the length between the left edge of the movable strip 212 and the vertical line 230 separating the rightmost number from the blank space 236). Conversely, to the right of each viewing aperture 210, the corresponding groove 218 must extend a distance that is sufficient to enable the blank space 236 and all but the last of the numbers on the associated movable strip 212 to be covered (i.e., the minimum distance from the right edge of the viewing aperture 210 to the right end of the groove 218 is equal to the length between vertical line 230 separating the leftmost number from the adjacent number and the right edge of the movable strip 212). These relative dimensions ensure that all of the numbers and the blank space 236 on each movable strip 212 are capable of being made selectively visible through the viewing aperture 210.

While the abovedescribed second embodiment of the invention does not includes a back cover, it is to be understood that, in other embodiments of the invention, a back cover 206 (see FIG. 14) can be included between the base plate 204 and the front cover 208. In embodiments with the back cover 206, the front cover 208 could be provided with a lip, which is similar to the lip 108*a* in the first embodiment, in order to accommodate the material thickness of the back cover 206. In still other embodiments of the invention, the base plate 204 is omitted in lieu of the back cover 206, and back cover 206 is directly attached to the band 202 via stitching (e.g., by sewing), an adhesive (e.g., a glue), fasteners, or by heat fusing the two materials together.

As described in regard to the first embodiment of the invention, the base plate 204, the back cover 206, and the front cover 208 are preferably formed from a flexible polymeric material or rubber that is readily bendable so as to improve the overall safety of the device 200.

Now, the operation of the device 200 for recording baseball or softball game data according to the second embodiment of the invention will be explained. The manner in which the device 200 is preferably placed on the user's limb is the same as that described with regard to the first embodiment, and thus, will not be reiterated here. In the initial state of the device 200 (e.g., before the baseball or softball game has commenced) all three movable strips 212 are in their leftmost positions such that the blank spaces 236 are visible through the three viewing apertures 210, and all of the numbers in first, second, and third pluralities of numbers 224, 226, 228 are covered by the front cover 208. Then, after a batter obtains his or her first strike or ball, either the movable strip 212 with the first plurality of numbers 224 thereon or the movable strip 212 with the second plurality of numbers 226 thereon is moved to the right by means of a user utilizing the finger engagement protrusion 222. The movable strip 212 is displaced to the right until the number "1" is substantially centered in the viewing aperture 210 of the front cover 208 (see e.g., number 216 in FIG. 8). The other numbers on the movable strip 212 are concealed behind the front cover 208. As the batter for which the count is being recorded acquires more balls or strikes, the appropriate movable strip 212 is moved to the right until the appropriate number is approximately centered in the viewing aperture 210. Once a batter acquires three strikes, the movable strip 212 associated with the third plurality of numbers 228 is moved to the right until the number "1" is substantially centered in the lower viewing aperture 210 of the front cover 208. Subsequent outs for a particular team are recorded by moving the lower movable strip 212 to the right until the number "2" or "3" is substantially centered in the lower viewing aperture 210 of the front cover 208.

3. Third Embodiment

Figure 15:
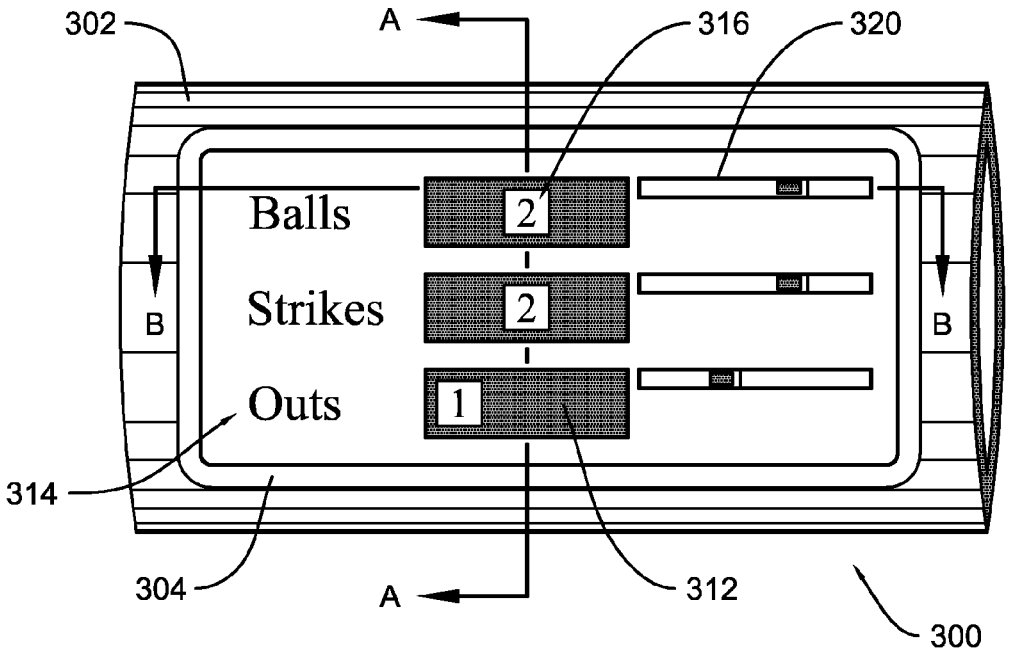
FIG. 15 is a front view of a device for recording baseball or softball game data according to a third embodiment of the invention.

A third embodiment of a device for recording baseball or softball game data is seen generally at 300 in FIG. 15. Like the devices 100 and 200 described above, the device 300 is a wearable type device, which is adapted to be worn by a user thereof. In some respects, the third embodiment is similar to that of the first and second embodiments. Moreover, some parts are common to all such embodiments. For the sake of brevity, the parts that the third embodiment of the device for recording baseball or softball game data has in common with the first and second embodiments will only be mentioned briefly because these components have already been explained in detail above.

However, it is evident from FIGS. 15-21 that the third embodiment of the device for recording baseball or softball game data also differs in several important respects from that of the first and second embodiments of the invention. The unique features of the third embodiment will be explained in detail below. One of ordinary skill in the art will appreciate that the constituent parts of the first, second, and third embodiments may be readily combined with one another without departing from the spirit and scope of the invention.

Now, referring to FIGS. 15-21, which illustrate various features of the third embodiment of the invention, it can be seen that the device 300 preferably includes a band 302, a base plate 304 attached to the band 302, a front cover 308 disposed on the base plate 304, a back cover 306 sandwiched between the front cover 308 and the base plate 304, and a plurality of movable strips 312 slidably disposed between the front cover 308 and the back cover 306. In the third embodiment of the invention, the movable strips 312 can be selectively displaced by a user so as to cover and uncover differing quantities of balls, strikes, or outs.

The physical construction of the band 302 and the base plate 304 in the third embodiment of the invention is the same as that described for the band 102 and the base plate 104 of the first embodiment, as is the manner in which the two components can be attached to one another. Thus, no further discussion of these components is necessary with regard to the third embodiment.

Figure 16:
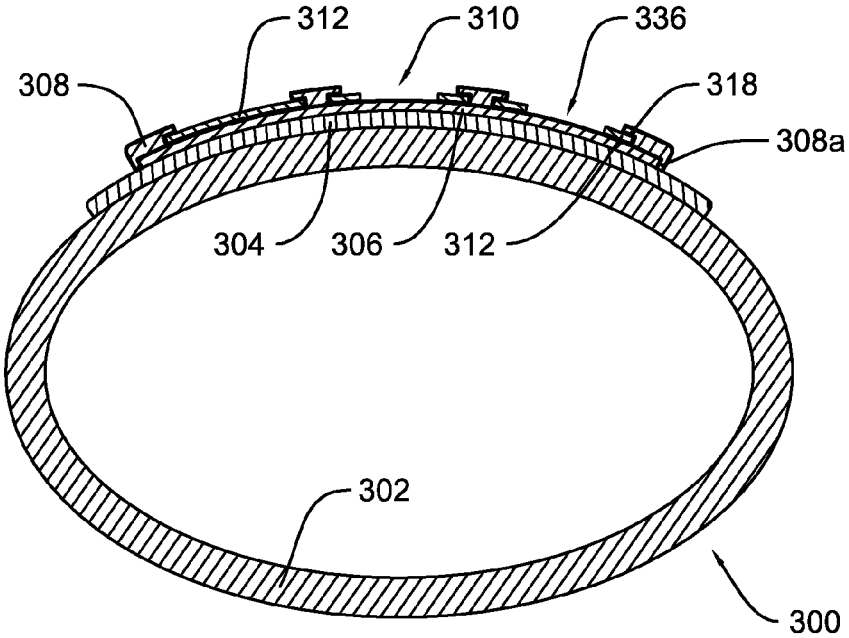
FIG. 16 is a transverse sectional view of the device for recording baseball or softball game data according to the third embodiment of the invention, which is cut along the cutting-plane line A-A in FIG. 15.
Figure 17:
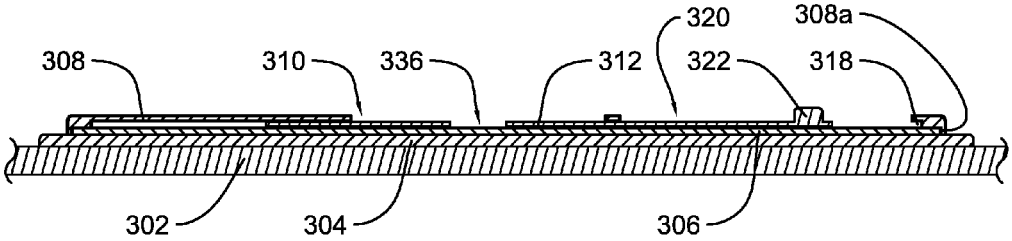
FIG. 17 is a partial longitudinal sectional view of the device for recording baseball or softball game data according to the third embodiment of the invention, which is cut along the cutting-plane line B-B in FIG. 15.
Figure 19:
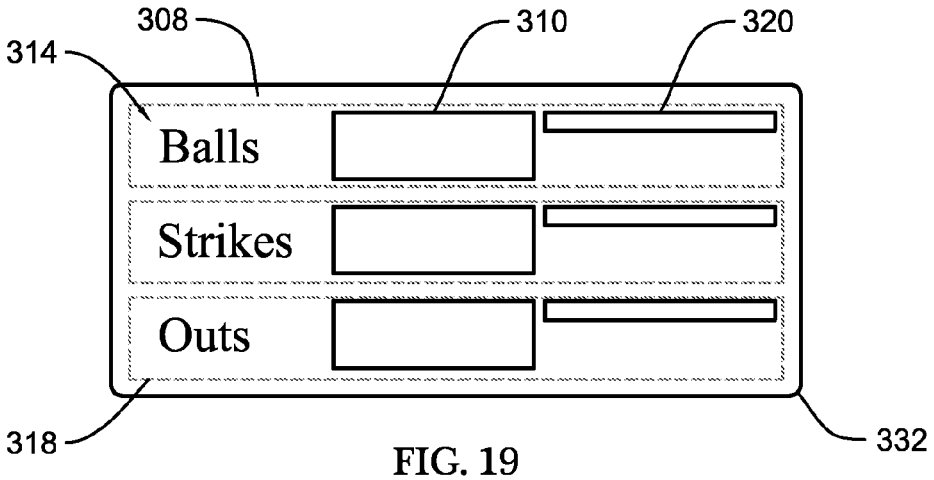
FIG. 19 is a front view of the front cover of the device for recording baseball or softball game data according to the third embodiment of the invention.
Figure 20:
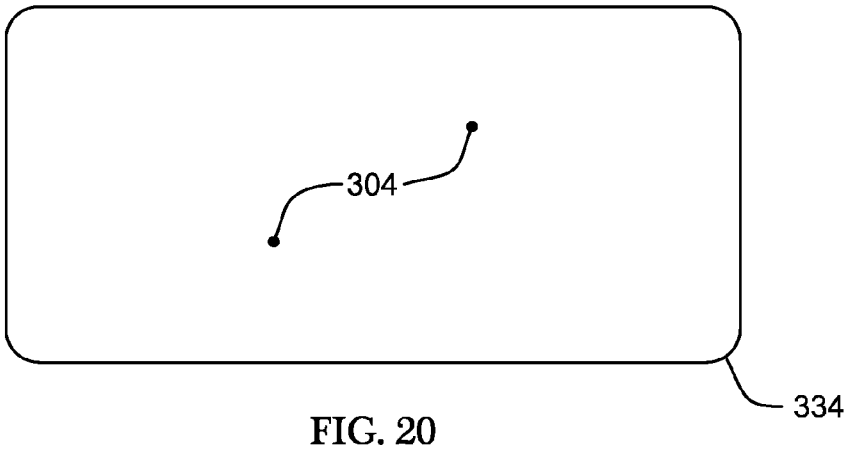
FIG. 20 is a front view of the base plate of the device for recording baseball or softball game data according to the third embodiment of the invention.

Referring to the sectional views in FIGS. 16 and 17, it can be seen that a rear peripheral lip 308*a* of front cover 308 is affixed to the front surface of the base plate 304, by utilizing the attachment means described in the discussion of the first embodiment. Additional features of the front cover 308 are more readily visible in FIG. 19. As shown in this figure, the front cover 308 is provided with a plurality of elongated viewing apertures 310 disposed therethrough, with labeling indicium 314 inscribed on the front cover 308 next to each one of the plurality of elongated viewing apertures 310. In the embodiment of FIG. 19, the indicia 314 are in the form of the words "Balls", "Strikes", and "Outs" and are positioned to the left of the elongated viewing apertures 310, but can be varied in the manner described with regard to the preceding two embodiments.

As represented by hidden lines in FIG. 19, the front cover 308 of the device 300 is provided with a plurality of grooves 318, each one accommodating a respective movable strip 312. The construction of the grooves 318 is very similar to that described above for the grooves 118, 218 of the first and second embodiments, and thus, further elaboration on such construction is not required here. In the third embodiment of the invention, each movable strip 312 is disposed between the front surface of the back cover 306 and the surfaces of a respective groove 318 and, similar to the two preceding embodiments, the inadvertent movement of each movable strip 312 is preferably prevented by the frictional engagement between the front and rear surfaces of each movable strip and the adjacent front and rear surfaces of the back cover 306 and front cover 308, respectively.

Still referring to FIG. 19, it can be seen that all three of the elongated viewing apertures 310 are substantially equal in size. More specifically, each viewing aperture 310 is generally rectangular in shape and is sized so as to accommodate a linear arrangement of three numbers therethrough, with one of the three numbers being made selectively viewable by means of the movable strip 312 (see FIG. 15, one number 316 is visible through the viewing aperture 336 of each movable strip 312). A finger engagement protrusion slot 320 is disposed to the right of each elongated viewing aperture 310 on the front cover 308. Each finger engagement protrusion slot 320 receives a displaceable finger engagement protrusion 322 of a respective movable strip 312 therein. Also, as shown in FIG. 19, the front cover 308 of the third embodiment of the invention is preferably provided with radiused corners 332 for the same reasons explained above with respect to the first and second embodiments. Moreover, referring now to the FIGS. 16 and 17, the top edges of the front cover 308 are preferably filleted to reduce sharp edges and prevent player injuries. Like the front cover 308, the base plate 304 is also provided with radiused corners 334 (see FIG. 20) and filleted top edges (refer to FIGS. 16 and 17).

Figure 21:
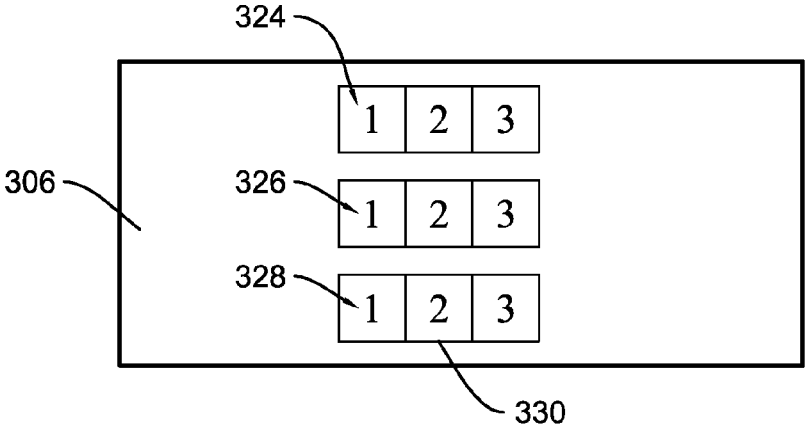
FIG. 21 is a front view of the back cover of the device for recording baseball or softball game data according to the third embodiment of the invention.

Next, the back cover 306 will be described in detail. As shown in FIG. 21, the back cover 306 includes a first, second, and third plurality of numbers 324, 326, and 328 inscribed on the front surface thereof, the numbers of each plurality of numbers 324, 326, 328 being arranged in a respective substantially linear arrangement on the back cover 306, and each plurality of numbers 324, 326, 328 being vertically spaced from apart from one another. The first plurality of numbers 324 represents differing quantities of balls (i.e., 1, 2, and 3). In this embodiment, the number "4" has been omitted from the set of numbers 324 representing differing quantities of balls in order to simplify the device 300 by making all three pluralities of numbers 324, 326, 328 the same, and to reduce the requisite overall length of the apparatus. The second plurality of numbers 326 represents differing quantities of strikes (i.e., 1, 2, and 3). And, the third plurality of numbers 328 represents differing quantities of outs (i.e., 1, 2, and 3). In FIG. 21, it can be seen that each number of the first, second, and third plurality of numbers 324, 326, and 328 is bounded by a border 330. The purpose of the border 330 around each number is to provide a positional guide for a user of the device 300 by defining the surrounding space associated with a particular number of balls, strikes, or outs. The techniques used to inscribe the first, second and third plurality of numbers 324, 326, 328 on the back cover are the same as those described for inscribing the first, second and third plurality of numbers 126, 128, 130 on the back cover 106 in the first embodiment, and thus, the aforedescribed discussion will not be repeated here.

Figure 18:
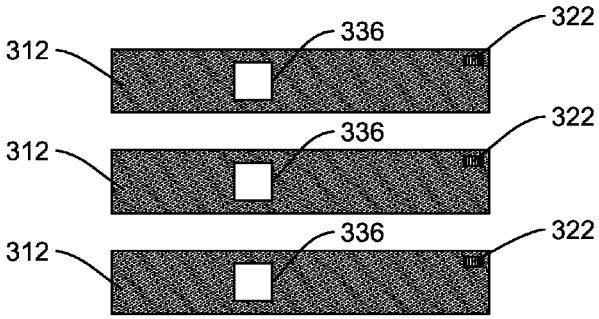
FIG. 18 is a front view of the movable strips of the device for recording baseball or softball game data according to the third embodiment of the invention.

Turning now to FIG. 18, the geometry of the movable strips 312 will be described. As shown in this figure, each of the three movable strips 312 is generally rectangular in shape, and includes a finger engagement protrusion 322 for facilitating the movement of the strip 312 by a user and a viewing aperture 336 for making a selected number 316 visible therethrough (see FIG. 15). Similar to the edges of the front cover 308, the front edges of each finger engagement protrusion 322 is filleted (see FIG. 17) so as to minimize the presence of sharp edges on the device 300, and the potential for player injuries resulting therefrom. As described above, each movable strip 312 is received within a corresponding groove 318 in the front cover 308. Referring to FIG. 17, it can be seen that the finger engagement protrusion 322 extends beyond the front surface of the front cover 308 so that the user is able to more easily engage the movable strip 312 and effectuate the movement thereof. As seen in FIG. 18, the viewing aperture 336 of each movable strip 312 is generally square in shape, while the finger engagement protrusion 322 of each movable strip 312 is generally rectangular in shape. However, it is to be understood that the invention is not so limited. Rather, both the viewing aperture 336 and the finger engagement protrusion 322 could be formed using other suitable shapes.

The length of each movable strip 312 is determined by the total length that is necessary to cover all of the numbers in the first, second, and third pluralities of numbers 324, 326, 328 when each movable strip 312 is in its leftmost position (i.e., the distance between the leftmost line of the border 330 in FIG. 21 and the rightmost line of that border 330) plus the width of the finger engagement protrusion 322 in the longitudinal direction of the movable strip 312 and the length that is necessary to cover two of the numbers in the first, second, and third pluralities of numbers 324, 326, 328 when each movable strip 312 is in its rightmost position (i.e., when the number "3" is selected).

The overall length of the groove 318 in the front cover 308 is determined by that which is necessary to accommodate the range of movement of the movable strips 312. To the left of each viewing aperture 310, the corresponding groove 318 must extend a distance that is sufficient to allow all of the numbers on the back cover 306 to be covered by the associated movable strip 312 (i.e., the minimum distance from the left edge of the viewing aperture 310 to the left end of the groove 318 is equal to the length between the leftmost vertical line of the border 330 and the rightmost line of the border 330). Conversely, to the right of each viewing aperture 310, the corresponding groove 318 must extend a distance that is sufficient to enable all but the last of the numbers on the back cover 306 to be covered (i.e., the minimum distance from the right edge of the viewing aperture 310 to the right end of the groove 318 is equal to the length between leftmost vertical line of the border 330 and the rightmost line of the border 330 plus the length required to accommodate the finger engagement protrusion 322). These relative dimensions ensure that all of the numbers on back cover 306 are capable of being made selectively visible through the viewing apertures 310 and 336, or alternatively, completely covered by the respective movable strip 312.

While the abovedescribed embodiment of the invention includes a back cover 306 on which the first, second, and third pluralities of numbers 324, 326, 328 are inscribed, it is to be understood that, in other embodiments of the invention, the back cover 306 is omitted and the first, second, and third pluralities of numbers 324, 326, 328, together with their associated borders 330, are inscribed directly on the base plate 304. In embodiments without the back cover 306, the lip 308*a* could be omitted from the front cover 308 because the purpose of the lip 308*a* is to accommodate the material thickness of the back cover 306. In still other embodiments of the invention, the base plate 304 is omitted in lieu of the back cover 306, and back cover 306 is directly attached to the band 302 via stitching (e.g., by sewing), an adhesive (e.g., a glue), fasteners, or by heat fusing the two materials together.

As described in regard to the first and second embodiments of the invention, the base plate 304, the back cover 306, and the front cover 308 are preferably formed from a flexible polymeric material or rubber that is readily bendable so as to improve the overall safety of the device 300.

Now, the operation of the device 300 for recording baseball or softball game data according to the third embodiment of the invention will be explained. The manner in which the device 300 is preferably placed on the user's limb is the same as that described with regard to the first and second embodiments, and thus, will not be reiterated here. In the initial state of the device 300 (e.g., before the baseball or softball game has commenced) all three movable strips 312 are in their leftmost positions such that all of the numbers in first, second, and third pluralities of numbers 324, 326, 328 are covered. Then, after a batter obtains his or her first strike or ball, either the movable strip 312 covering the first plurality of numbers 324 or the movable strip 312 covering the second plurality of numbers 326 is moved to the right until the number "1" is substantially centered in the viewing aperture 336 of associated movable strip 312 by means of a user utilizing the finger engagement protrusion 322. As a result of displacing the movable strip 312 in such a manner, the number "1" is visible to the user through the viewing aperture 336 in the movable strip 312 and the elongated viewing aperture 310 in the front cover 308 (see e.g., number 316 in FIG. 15), while the other numbers of the first, second, and third pluralities of numbers 324, 326, 328 remain covered by the solid portions of the movable strips 312. As the batter for which the count is being recorded acquires more balls or strikes, the viewing aperture 336 of the appropriate movable strip 312 is substantially centered on the appropriate number in the manner described above for the initial ball or strike. Once a batter acquires three strikes, the viewing aperture 336 of the lower movable strip 312 is substantially centered on the number "1" of the third plurality of numbers 328 (see e.g., FIG. 15) for indicating the first out. Subsequent outs for a particular team are recorded by moving the movable strip 312 to the right until its viewing aperture 336 is substantially centered on the numbers "2" and "3" of the third plurality of numbers 328.

4. Fourth Embodiment

Figure 22:
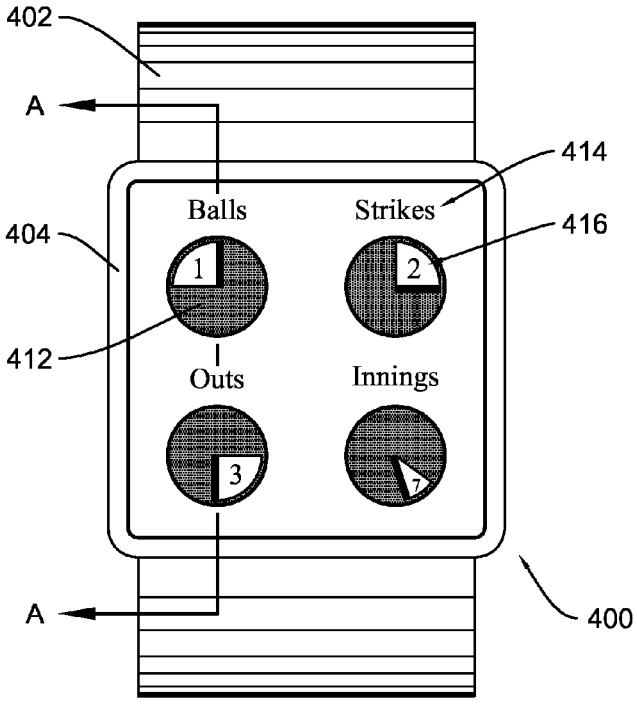
FIG. 22 is a front view of a device for recording baseball or softball game data according to a fourth embodiment of the invention.

A fourth embodiment of a device for recording baseball or softball game data is seen generally at 400 in FIG. 22. Like the devices 100, 200, and 300 described above, the device 400 is a wearable type device, which is adapted to be worn by a user thereof. In some respects, the fourth embodiment is similar to that of the first, second, and third embodiments. Moreover, some parts are common to all such embodiments. For the sake of brevity, the parts that the fourth embodiment of the device for recording baseball or softball game data has in common with the first, second, and third embodiments will only be mentioned briefly because these components have already been explained in detail above.

However, it is evident from FIGS. 22-26 that the fourth embodiment of the device for recording baseball or softball game data also differs in several important respects from that of the first, second, and third embodiments of the invention. The unique features of the fourth embodiment will be explained in detail below. One of ordinary skill in the art will appreciate that the constituent parts of all embodiments disclosed herein may be readily combined with one another without departing from the spirit and scope of the invention.

Now, referring to FIGS. 22-26, which illustrate various features of the fourth embodiment of the invention, it can be seen that the device 400 preferably includes a band 402, a base plate 404 attached to the band 402, a front cover 408 disposed on the base plate 404, a back cover 406 sandwiched between the front cover 408 and the base plate 404, and a plurality of movable disks 412 rotatably disposed between the front cover 408 and the back cover 406. In the fourth embodiment of the invention, the movable disks 412 can be selectively displaced by a user so as to cover and uncover differing quantities of balls, strikes, outs, or innings.

Figure 23:
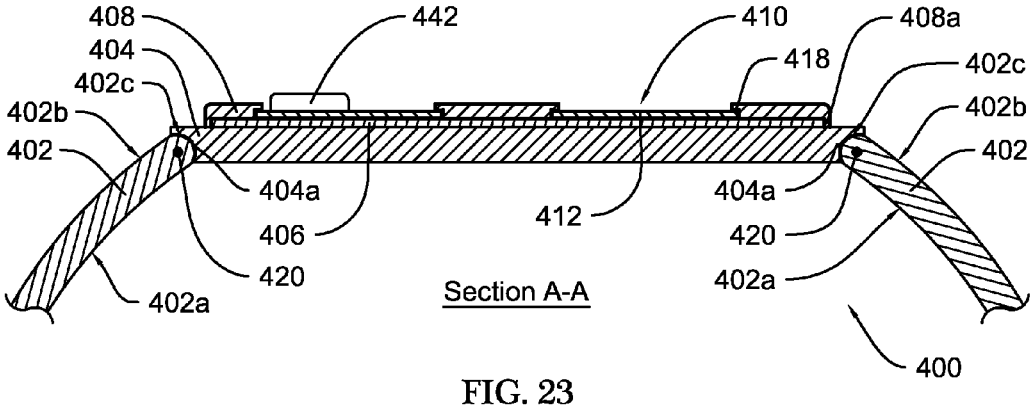
FIG. 23 is a partial longitudinal sectional view of the device for recording baseball or softball game data according to the fourth embodiment of the invention, which is cut along the cutting-plane line A-A in FIG. 22.

As best shown in FIGS. 22 and 23, the base plate 404 of the device 400 is rotatably attached to an end portion 402*c* of the band 402 via a pin 420. The base plate 404 has a slightly greater width than the band 402, and has grooved portions 404*a* on the back side thereof for accommodating the end portions 402*c* of the band 402. While not explicitly shown in the drawings, the grooved portions 404*a* do not extend the entire width of the base plate 404 so that the movement of the band 402 is restricted in a lateral direction. The opposite ends of the pins 420 are held in place by full cross-sectional portions of the base plate 404 that flank the lateral sides of the grooved portions 404*a*. Thus, each end portion 402*c* of the band 402 is substantially restricted to rotational movement about a longitudinal axis of a respective pin 420. When the device 400 is worn by a user, the inner surface 402*a* of the band 402 faces inwardly towards the circumference of the user's limb, while the outer surface 402*b* of the band 402 faces outwardly away from the circumference of the user's limb. In a preferred embodiment of the invention, the band 402 depicted in FIGS. 22 and 23 is in the form of a wrist band (e.g., a watch-type wrist band), which is formed in two halves that can be fastened together by a clasp or buckle. Preferably, the two halves of the band 402 are formed from a flexible polymer in order to prevent player injuries. Although, one of ordinary skill in the art will appreciate that the band 402 can also be formed from a continuous piece of stretchable material, such as a woven fabric, without departing from the scope and spirit of the invention.

Figure 24:
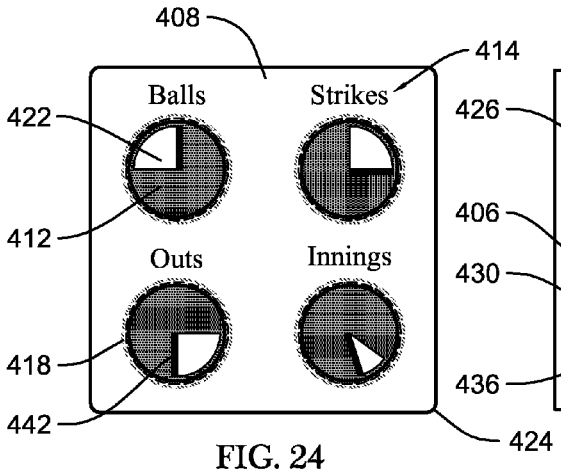
FIG. 24 is a front view of the front cover and movable disks of the device for recording baseball or softball game data according to the fourth embodiment of the invention.

Referring to the sectional view of FIG. 23, it can be seen that a rear peripheral lip 408*a* of front cover 408 is affixed to the front surface of the base plate 404, by utilizing the attachment means described in the discussion of the first embodiment. Also, as shown in FIGS. 22 and 23, the front cover 408 is provided with a plurality of substantially circular viewing apertures 410 disposed therethrough for viewing a particular quantity of balls, strikes, outs, or innings. Additional features of the front cover 408 are more readily visible in FIG. 24. As illustrated in this figure, the front cover 408 is provided with labeling indicium 414 inscribed thereon next to each one of the plurality of substantially circular viewing apertures 410. In the embodiment of FIG. 24, the indicia 414 are in the form of the words "Balls", "Strikes", "Outs", and "Innings" and are positioned generally above each of the substantially circular viewing apertures 410, but can be varied in the manner described above with regard to the other embodiments of the invention.

As represented by the outermost circular hidden lines in FIG. 24, the front cover 408 of the device 400 is provided with a plurality of circular grooves 418, each one accommodating a respective movable disk 412. Other than their circular geometry, the construction of the grooves 418 is similar to that described above for the grooves 118, 218, 318 of the preceding three embodiments, and thus, further elaboration on such construction is not required here. In the fourth embodiment of the invention, each movable disk 412 is disposed between the front surface of the back cover 406 and the surfaces of a respective groove 418 and, similar to the three aforedescribed embodiments, the inadvertent movement of each movable disk 412 is preferably prevented by the frictional engagement between the front and rear surfaces of each movable disk and the adjacent front and rear surfaces of the back cover 406 and front cover 408, respectively.

Still referring to FIG. 24, it can be seen that all four of the substantially circular viewing apertures 410 are substantially equal in size (as defined by the innermost circular lines, which are solid). More specifically, each substantially circular viewing aperture 410 is sized so as to accommodate a semi-circular arrangement of numbers selectively visible therethrough, with one of the numbers being made selectively viewable by means of the movable disk 412 (see FIG. 22, one number 416 is visible through the viewing aperture 422 of each movable disk 412). Also, as shown in FIG. 24, the front cover 408 of the fourth embodiment of the invention is preferably provided with radiused corners 424 for the same reasons explained above with respect to the preceding three embodiments. Moreover, referring now to FIG. 23, the top edges of the front cover 408 are preferably filleted to reduce sharp edges and prevent player injuries. Like the front cover 408, the base plate 404 is also provided with radiused corners 438 (see FIG. 26).

Figure 25:
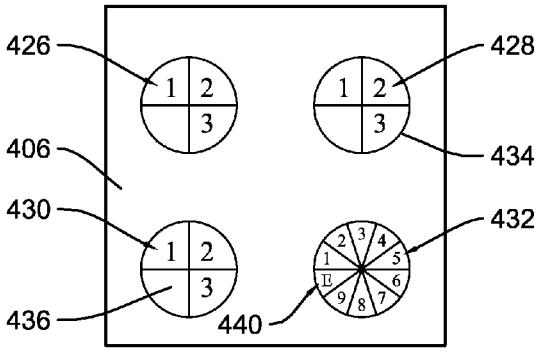
FIG. 25 is a front view of the back cover of the device for recording baseball or softball game data according to the fourth embodiment of the invention.
Figure 26:
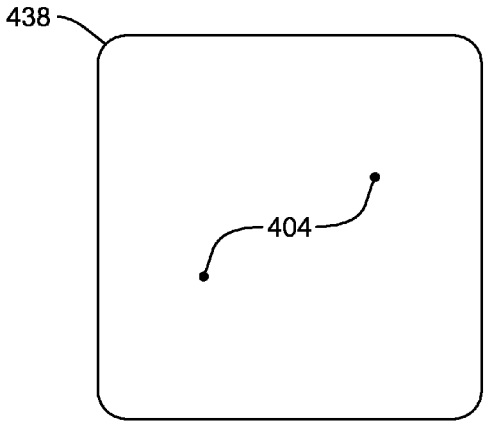
FIG. 26 is a front view of the base plate of the device for recording baseball or softball game data according to the fourth embodiment of the invention.

Next, the back cover 406 will be described in detail. As shown in FIG. 25, the back cover 406 includes a first, second, third, and fourth plurality of numbers 426, 428, 430, and 432 inscribed on the front surface thereof, the numbers of each plurality of numbers 426, 428, 430, 432 being arranged in a respective semi-circular arrangement on the back cover 406, and each plurality of numbers 426, 428, 430, 432 being spaced from apart from one another. The first plurality of numbers 426 represents differing quantities of balls (i.e., 1, 2, and 3). In this embodiment, the number "4" has been omitted from the set of numbers 426 representing differing quantities of balls in order to simplify the device 400 by making three out of the four pluralities of numbers the same, and to allow one-quarter of the substantially circular arrangement of numbers to be used for a blank space 436. The second plurality of numbers 428 represents differing quantities of strikes (i.e., 1, 2, and 3), whereas the third plurality of numbers 430 represents differing quantities of outs (i.e., 1, 2, and 3). And finally, the fourth plurality of numbers 432 represents different innings in a baseball game (i.e., 1, 2, 3, 4, 5, 6, 7, and 9). In addition to the fourth plurality of numbers 432, the letter "E", as denoted by reference character 440, is also provided in the innings category in order to designate extra innings in a baseball game (i.e., any inning number greater than 9). While a total of nine (9) regular innings are used in the exemplary embodiment, it is to be understood that the invention is not so limited. Rather, in other embodiments of the invention, only seven (7) regular innings could be used (e.g., as in a typical softball game). In FIG. 25, it can be seen that each number of the first, second, third, and fourth plurality of numbers 426, 428, 430, and 432 is bounded by a border 434. The purpose of the border 434 around each number is to provide a positional guide so that the user of the device 400 displaces the movable disk 412 to the correct position for a particular number of balls, strikes, outs, or innings. When selecting a particular number on the device 400, the user preferably displaces the movable strip 412 until the substantially straight lines of the wedge-shaped viewing aperture 422 are substantially aligned with the substantially straight border lines disposed on opposite sides of the desired number. For example, in FIG. 22, the substantially straight lines of the wedge-shaped viewing aperture 422 for selecting the quantity of balls are substantially aligned with the substantially straight border lines disposed on opposite sides of the number "1", the substantially straight lines of the wedge-shaped viewing aperture 422 for selecting the quantity of strikes are substantially aligned with the substantially straight border lines disposed on opposite sides of the number "2", the substantially straight lines of the wedge-shaped viewing aperture 422 for selecting the quantity of outs are substantially aligned with the substantially straight border lines disposed on opposite sides of the number "3", and the substantially straight lines of the wedge-shaped viewing aperture 422 for selecting the inning are substantially aligned with the substantially straight border lines disposed on opposite sides of the number "7".

The techniques used to inscribe the first, second, third, and fourth plurality of numbers 426, 428, 430, and 432 on the back cover 406 are the same as those described for inscribing the first, second and third plurality of numbers 126, 128, 130 on the back cover 106 in the first embodiment, and thus, the aforedescribed discussion will not be repeated here.

Referring again to FIG. 24, the structure of the movable disks 412 will be described in more detail. As shown in this figure, each of the four movable disks 412 includes a finger engagement protrusion 442 for facilitating the movement of the disk 412 by a user and a wedge-shaped viewing aperture 422 (i.e., a pie-shaped sector) for making a selected number 416 visible therethrough (see FIG. 22). Similar to the edges of the front cover 408, the front edges of each finger engagement protrusion 442 is filleted (see FIG. 23) so as to minimize the presence of sharp edges on the device 400, and the potential for player injuries resulting therefrom. As described above, each movable disk 412 is received within a corresponding groove 418 in the front cover 408. Referring to FIG. 23, it can be seen that the finger engagement protrusion 442 extends beyond the front surface of the front cover 408 so that the user is able to more easily engage the movable disk 412 and effectuate the movement thereof. As seen in FIGS. 22 and 24, the finger engagement protrusion 442 of each movable disk 412 is generally rectangular in shape. However, it is to be understood that the invention is not so limited. Rather, the finger engagement protrusion 442 could be formed using other suitable shapes. While a pie-shaped sector is preferred, it is also possible to use other shapes for the viewing aperture 422, such as a substantially circular opening.

The requisite area of the solid portion of each movable disk 412 is determined by the total area that is necessary to cover all but one of the numbers in the first, second, third, and fourth pluralities of numbers 426, 428, 430, and 432.

While the abovedescribed embodiment of the invention includes a back cover 406 on which the first, second, third, and fourth pluralities of numbers 426, 428, 430, and 432 are inscribed, it is to be understood that, in other embodiments of the invention, the back cover 406 is omitted and the first, second, third, and fourth pluralities of numbers 426, 428, 430, and 432, together with their associated borders 434, are inscribed directly on the base plate 404. In embodiments without the back cover 406, the lip 408*a* could be omitted from the front cover 408 because the purpose of the lip 408*a* is to accommodate the material thickness of the back cover 406.

As described in regard to the preceding three embodiments of the invention, the base plate 404, the back cover 406, and the front cover 408 are preferably formed from a flexible polymeric material or rubber that is readily bendable so as to improve the overall safety of the device 400.

Now, the operation of the device 400 for recording baseball or softball game data according to the fourth embodiment of the invention will be explained. First, in a preferred embodiment, a user places the device 400 around one of his or her limbs (e.g., an arm) and fastens the two halves of the band 402 together using the snap or buckle provided therewith. In the initial state of the device 400 (e.g., at the beginning of the baseball or softball game) the movable disks 412 associated with the first, second, and third pluralities of numbers are 426, 428, and 430 are each rotated to the position in which the blank space 436 is visible through their respective viewing apertures 422, thereby denoting that no quantity of balls, strikes, or outs is established yet. Also, the movable disk 412 associated with the fourth plurality of numbers 432 is rotated to the position in which the number "1" is substantially centered in the viewing aperture of the movable disk 412. Then, after a batter obtains his or her first strike or ball, either the movable disk 412 covering the first plurality of numbers 426 or the movable strip 412 covering the second plurality of numbers 428 is moved clockwise, or counter-clockwise, until the number "1" is substantially centered in the viewing aperture 422 of the associated movable disk 412 by means of a user utilizing the finger engagement protrusion 442. As a result of displacing the movable disk 412 in such a manner, the number "1" is visible to the user through the viewing aperture 422 in the movable disk 412 and the substantially circular viewing aperture 410 in the front cover 408 (see e.g., number 416 in FIG. 22), while the other numbers of the first, second, and third pluralities of numbers 426, 428, and 430 remain covered by the solid portions of the movable disks 412. As the batter for which the count is being recorded acquires more balls or strikes, the viewing aperture 422 of the appropriate movable disk 412 is substantially centered on the appropriate number in the manner described above for the initial ball or strike. Once a batter acquires three strikes, the viewing aperture 422 of the movable disk 412 in the lower left corner of the front cover 408 is substantially centered on the number "1" of the third plurality of numbers 430 (see e.g., FIG. 22) for indicating the first out. Subsequent outs for a particular team are recorded by moving the movable disk 412 clockwise, or counter-clockwise, until its viewing aperture 422 is substantially centered on the numbers "2" and "3" of the third plurality of numbers 430. The subsequent innings of the baseball or softball game are recorded in the same manner as that described above for the balls, strikes, and outs.

Although the invention has been shown and described with respect to a certain embodiment or embodiments, it is apparent that this invention can be embodied in many different forms and that many other modifications and variations are possible without departing from the spirit and scope of this invention. For example, the viewing apertures 110, 210, 310 can be formed using other suitable shapes in addition to those described above, such as a circular geometry. Moreover, as another example, viewing windows formed from a transparent material could be substituted for the viewing apertures 110, 210, 310, 410 of the abovedescribed embodiments. Furthermore, while innings are only explicitly described with regard to the fourth embodiment, it is to be understood that an innings recordation device could be included in the other embodiments of the invention as well.

While exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A device for recording baseball or softball game data, the device comprising:

a band adapted to fit around a limb of a user, said band having an inner surface configured to face inwardly towards the circumference of said limb, and an opposed, outer surface configured to face outwardly away from said circumference of said limb;

a base plate attached to said outer surface of said band or an end portion of said band;

a front cover attached to said base plate, said front cover having at least one aperture disposed therethrough or at least one viewing window disposed therein;

a back cover disposed between said front cover and said base plate;

at least one plurality of numbers, said plurality of numbers configured to represent differing quantities of balls, strikes, outs, or innings during a baseball or softball game inscribed on said device; at least one number of said at least one plurality of numbers configured to be visible through said aperture or said viewing window of said front cover; and at least one indicium inscribed on said device near said at least one plurality of numbers, said indicium labeling said plurality of numbers as either balls, strikes, outs, or innings;

wherein said at least one plurality of numbers is inscribed on said back cover in a substantially linear arrangement.

2. The device according to claim 1, further comprising at least one movable strip slidably disposed between said front cover and said back cover, said at least one movable strip being configured to cover one or more of said numbers such that a particular quantity, or quantities, of said balls, strikes, or outs is made selectively visible; wherein said at least one movable strip is displaceable in a substantially linear manner by said user.

3. The device according to claim 2, wherein said front cover comprises at least one groove configured to receive said at least one movable strip, said at least one movable strip being slidably disposed in said at least one groove; and wherein said at least one movable strip comprises a finger engagement protrusion disposed on one longitudinal end for facilitating a movement of said at least one movable strip by a user, said finger engagement protrusion extending beyond a front surface of said front cover.

4. The device according to claim 1, further comprising at least one movable strip slidably disposed between said front cover and said back cover, said at least one movable strip having a viewing aperture disposed therethrough; wherein said at least one movable strip is configured to cover at least two numbers of said at least one plurality of numbers such that a particular quantity of said balls, strikes, or outs is made selectively visible through said viewing aperture of said at least one movable strip; and wherein said at least one movable strip is displaceable in a substantially linear manner by said user.

5. The device according to claim 1, wherein said at least one plurality of numbers comprises a first plurality of numbers representing differing quantities of said balls, a second plurality of numbers representing differing quantities of said strikes, and a third plurality of numbers representing differing quantities of said outs; wherein the numbers in each of said first, second, and third pluralities of numbers are inscribed in a respective substantially linear arrangement across said back cover; and wherein said first plurality of numbers is located above said second plurality of numbers, and said second plurality of numbers is located above said third plurality of numbers.

6. The device according to claim 5, further comprising three independently movable strips disposed between said front cover and said back cover, the first of said three independently movable strips being configured to cover one or more numbers of said first plurality of numbers representing said differing quantities of said balls, the second of said three independently movable strips being configured to cover one or more numbers of said second plurality of numbers representing said differing quantities of said strikes, and the third of said three independently movable strips being configured to cover one or more numbers of said third plurality of numbers representing said differing quantities of said outs.

7. The device according to claim 5, further comprising three independently movable strips disposed between said front cover and said back cover, each of said three independently movable strips having a viewing aperture disposed therethrough; the first of said three independently movable strips being configured to cover at least two numbers of said first plurality of numbers representing said differing quantities of said balls such that a particular quantity of said balls is made selectively visible through said viewing aperture of said first independently movable strip, the second of said three independently movable strips being configured to cover at least two numbers of said second plurality of numbers representing said differing quantities of said strikes such that a particular quantity of said strikes is made selectively visible through said viewing aperture of said second independently movable strip, and the third of said three independently movable strips being configured to cover at least two numbers of said third plurality of numbers representing said differing quantities of said outs such that a particular quantity of said outs is made selectively visible through said viewing aperture of said third independently movable strip.

8. The device according to claim 1, wherein said band is in the form of a wrist band or an arm band.

9. The device according to claim 8, wherein said wrist band or arm band is formed from a continuous loop of terrycloth that is both stretchable and capable of absorbing moisture.

10. The device according to claim 1, wherein at least one of said base plate and said front cover is formed from rubber or another pliable polymeric material.

11. The device according to claim 1, wherein said at least one indicium comprises one of the following:

(1) a first letter abbreviation for the word "balls", "strikes", or "outs" inscribed on said device near said at least one plurality of numbers; or (2) the complete word "balls", "strikes", or "outs" inscribed on said device near said at least one plurality of numbers.

12. A device for recording baseball or softball game data, the device comprising:

a band adapted to fit around a limb of a user, said band having an inner surface configured to face inwardly towards the circumference of said limb, and an opposed, outer surface configured to face outwardly away from said circumference of said limb;

a base plate attached to said outer surface of said band;

a front cover attached to said base plate, said front cover having at least one aperture disposed therethrough or at least one viewing window disposed therein;

at least one displaceable member movably disposed between said front cover and said base plate;

at least one plurality of numbers, said plurality of numbers configured to represent differing quantities of balls, strikes, or outs during a baseball or softball game inscribed on said base plate; at least one number of said at least one plurality of numbers being visible through said aperture or said viewing window of said front cover; and at least one indicium inscribed on said device near said at least one plurality of numbers, said indicium labeling said plurality of numbers as either balls, strikes, or outs;

wherein said at least one displaceable member is configured to cover one or more numbers of said plurality of numbers such that a particular quantity, or quantities, of said balls, strikes, or outs is made selectively visible.

13. The device according to claim 12, wherein said at least one plurality of numbers comprises a first plurality of numbers representing differing quantities of said balls, a second plurality of numbers representing differing quantities of said strikes, and a third plurality of numbers representing differing quantities of said outs; wherein the numbers in each of said first, second, and third pluralities of numbers are inscribed in a respective substantially linear arrangement across said base plate, said first plurality of numbers being located above said second plurality of numbers, and said second plurality of numbers being located above said third plurality of numbers; and wherein at least one displaceable member comprises three independently movable strips disposed between said front cover and said base plate, the first of said three independently movable strips being configured to cover one or more numbers of said first plurality of numbers representing said differing quantities of said balls, the second of said three independently movable strips being configured to cover one or more numbers of said second plurality of numbers representing said differing quantities of said strikes, and the third of said three independently movable strips being configured to cover one or more numbers of said third plurality of numbers representing said differing quantities of said outs.

14. A device for recording baseball or softball game data, the device comprising:

a base plate;

a front cover attached to said base plate, said front cover having a plurality of apertures disposed therethrough or a plurality of viewing windows disposed therein;

a plurality of displaceable members movably disposed between said front cover and said base plate;

a first plurality of numbers configured to represent differing quantities of balls during a baseball or softball game inscribed on said base plate, at least one number of said first plurality of numbers being visible through a first of said plurality of apertures or a first of said plurality of viewing windows in said front cover;

a second plurality of numbers configured to represent differing quantities of strikes during a baseball or softball game inscribed on said base plate, at least one number of said second plurality of numbers being visible through a second of said plurality of apertures or a second of said plurality of viewing windows in said front cover;

a third plurality of numbers configured to represent differing quantities of outs during a baseball or softball game inscribed on said base plate, at least one number of said third plurality of numbers being visible through a third of said plurality of apertures or a third of said plurality of viewing windows in said front cover;

a first indicium inscribed on said device near said first plurality of numbers, said first indicium labeling said first plurality of numbers as balls;

a second indicium inscribed on said device near said second plurality of numbers, said second indicium labeling said second plurality of numbers as strikes; and a third indicium inscribed on said device near said third plurality of numbers, said third indicium labeling said third plurality of numbers as outs;

wherein a first of said plurality of displaceable members is configured to cover one or more numbers of said first plurality of numbers such that a particular quantity, or quantities, of said balls is made selectively visible;

wherein a second of said plurality of displaceable members is configured to cover one or more numbers of said second plurality of numbers such that a particular quantity, or quantities, of said strikes is made selectively visible; and wherein a third of said plurality of displaceable members is configured to cover one or more numbers of said third plurality of numbers such that a particular quantity, or quantities, of said outs is made selectively visible.

15. The device according to claim 14, wherein said plurality of displaceable members comprises three independently movable strips disposed between said front cover and said base plate, each of said three independently movable strips having a viewing aperture disposed therethrough; the first of said three independently movable strips being configured to cover at least two numbers of said first plurality of numbers representing said differing quantities of said balls such that a particular quantity of said balls is made selectively visible through said viewing aperture of said first independently movable strip, the second of said three independently movable strips being configured to cover at least two numbers of said second plurality of numbers representing said differing quantities of said strikes such that a particular quantity of said strikes is made selectively visible through said viewing aperture of said second independently movable strip, and the third of said three independently movable strips being configured to cover at least two numbers of said third plurality of numbers representing said differing quantities of said outs such that a particular quantity of said outs is made selectively visible through said viewing aperture of said third independently movable strip.

16. A device for recording baseball or softball game data, the device comprising:

a band adapted to fit around a limb of a user, said band having an inner surface configured to face inwardly towards the circumference of said limb, and an opposed, outer surface configured to face outwardly away from said circumference of said limb;

a base plate attached to said outer surface of said band;

a front cover attached to said base plate, said front cover having at least one aperture disposed therethrough or at least one viewing window disposed therein;

at least one displaceable member movably disposed between said front cover and said base plate;

at least one plurality of numbers, said plurality of numbers configured to represent differing quantities of balls, strikes, or outs during a baseball or softball game inscribed on said device; at least one number of said at least one plurality of numbers being visible through said aperture or said viewing window of said front cover; and at least one indicium inscribed on said device near said at least one plurality of numbers, said indicium labeling said plurality of numbers as either balls, strikes, or outs;

wherein said at least one displaceable member or said front cover is configured to cover one or more numbers of said plurality of numbers such that a particular quantity, or quantities, of said balls, strikes, or outs is made selectively visible.

17. The device according to claim 16, further comprising a back cover disposed between said front cover and said base plate; wherein said at least one displaceable member comprises at least one movable disk rotatably disposed between said front cover and said back cover, said at least one movable disk having a viewing aperture disposed therethrough;

wherein said at least one plurality of numbers is inscribed on said back cover in a semi-circular arrangement; and wherein said at least one movable disk is configured to cover at least two numbers of said plurality of numbers such that either a blank space or a particular quantity of said balls, strikes, or outs is made selectively visible through said viewing aperture of said at least one movable disk; said at least one movable disk being displaceable in a substantially circular manner by said user.

18. The device according to claim 16, further comprising a back cover disposed between said front cover and said base plate; wherein said at least one displaceable member comprises four independently movable disks rotatably disposed between said front cover and said back cover, each of said four independently movable disks having a viewing aperture disposed therethrough;

wherein said at least one plurality of numbers comprises a first plurality of numbers representing differing quantities of said balls, a second plurality of numbers representing differing quantities of said strikes, a third plurality of numbers representing differing quantities of said outs, and a fourth plurality of numbers representing differing quantities of said innings, the numbers in each of said first, second, third, and fourth pluralities of numbers being inscribed on said back cover in a respective semi-circular arrangement; and wherein the first of said four independently movable disks is configured to cover at least two numbers of said first plurality of numbers representing said differing quantities of said balls such that either a blank space or a particular quantity of said balls is made selectively visible through said viewing aperture of said first independently movable disk, the second of said four independently movable disks is configured to cover at least two numbers of said second plurality of numbers representing said differing quantities of said strikes such that either a blank space or a particular quantity of said strikes is made selectively visible through said viewing aperture of said second independently movable disk, the third of said four independently movable disks is configured to cover at least two numbers of said third plurality of numbers representing said differing quantities of said outs such that either a blank space or a particular quantity of said outs is made selectively visible through said viewing aperture of said third independently movable disk, and the fourth of said four independently movable disks is configured to cover at least eight numbers of said fourth plurality of numbers representing said differing quantities of said innings such that a particular quantity of said innings is made selectively visible through said viewing aperture of said fourth independently movable disk.

19. The device according to claim 16, wherein said at least one displaceable member comprises a movable strip, wherein said at least one plurality of numbers is inscribed on said movable strip in a substantially linear arrangement, said movable strip being slidably disposed between said front cover and said base plate; wherein one number of said plurality of numbers is configured to be selectively visible through said aperture or said viewing window of said front cover, and the remainder of said plurality of numbers are configured to be concealed behind said front cover of said device.

20. The device according to claim 16, wherein said at least one displaceable member comprises three independently movable strips slidably disposed between said front cover and said base plate;

wherein said at least one plurality of numbers comprises a first plurality of numbers representing differing quantities of said balls, a second plurality of numbers representing differing quantities of said strikes, and a third plurality of numbers representing differing quantities of said outs, the numbers in said first plurality of numbers being inscribed on the first of said three independently movable strips in a substantially linear manner, the numbers in said second plurality of numbers being inscribed on the second of said three independently movable strips in a substantially linear manner, and the numbers in said third plurality of numbers being inscribed on the third of said three independently movable strips in a substantially linear manner;

wherein said at least one aperture or said at least one viewing window of said front cover comprises three apertures disposed through said front cover or three viewing windows disposed in said front cover;

wherein one number of said first plurality of numbers is configured to be selectively visible through a first of said three apertures or a first of said three viewing windows in said front cover and the remainder of said first plurality of numbers are configured to be concealed behind said front cover; one number of said second plurality of numbers is configured to be selectively visible through a second of said three apertures or a second of said three viewing windows in said front cover and the remainder of said second plurality of numbers are configured to be concealed behind said front cover; and one number of said third plurality of numbers is configured to be selectively visible through a third of said three apertures or a third of said three viewing windows in said front cover and the remainder of said third plurality of numbers are configured to be concealed behind said front cover.

* * * * *